US008084701B1

(12) United States Patent
Misner

(10) Patent No.: US 8,084,701 B1
(45) Date of Patent: Dec. 27, 2011

(54) PUSH BUTTON ACTUATOR

(75) Inventor: Michael O. Misner, Lake Villa, IL (US)

(73) Assignee: The Eastern Company, Wheeling, IL (US)

( * ) Notice: Subject to any disclaimer, the term of this patent is extended or adjusted under 35 U.S.C. 154(b) by 440 days.

(21) Appl. No.: 12/455,741

(22) Filed: Jun. 5, 2009

(51) Int. Cl.
*H01H 9/28* (2006.01)

(52) U.S. Cl. ..... 200/43.13; 200/566; 200/329

(58) Field of Classification Search ..... 200/329, 200/341, 43.13, 573, 43.08, 566; 70/360, 70/367

See application file for complete search history.

(56) References Cited

U.S. PATENT DOCUMENTS

| | | | | |
|---|---|---|---|---|
| 113,070 | A | 3/1871 | Loeffelholz et al. | 292/34 |
| 417,589 | A | 12/1889 | Rose | 292/40 |
| 480,148 | A | 8/1892 | Theby | 292/36 |
| 491,824 | A | 2/1893 | Walker | 200/61.64 |
| 767,567 | A | 8/1904 | Keil | 292/127 |
| 876,300 | A | 1/1908 | Courlet | 292/135 |
| 925,455 | A | 6/1909 | Campbell | 70/81 |
| 1,018,077 | A | 2/1912 | Petterson | 70/150 |
| 1,058,346 | A | 4/1913 | Berstler | 292/21 |
| 1,174,652 | A | 3/1916 | Banks | 292/36 |
| 1,368,141 | A | 2/1921 | Hagstrom | 292/34 |
| 1,531,605 | A | 3/1925 | Gaynor | 200/535 |
| 1,556,864 | A | 10/1925 | Mendenhall | 292/33 |
| 1,571,453 | A | 2/1926 | Maxon | 292/170 |
| 1,611,940 | A | 12/1926 | Ohmer | 464/37 |
| 1,662,423 | A | 3/1928 | Jacobi | 70/360 |
| 1,672,901 | A | 6/1928 | North | 292/227 |
| 1,908,980 | A | 5/1933 | Heyel | 70/120 |
| 1,937,165 | A | 11/1933 | Pagneri | 70/53 |
| 1,965,939 | A | 7/1934 | Jacobi | 70/29 |
| 2,033,252 | A | 3/1936 | Parker | 200/11 |
| 2,059,479 | A | 11/1936 | North | 292/127 |
| 2,118,012 | A | 5/1938 | Lowe | 200/44 |
| 2,257,741 | A | 10/1941 | Gray | 70/85 |
| 2,261,472 | A | 11/1941 | Hurd | 70/455 |
| 2,322,040 | A | 6/1943 | Maruri | 70/145 |
| 2,580,548 | A | 1/1952 | Jacobi | 70/370 |
| 2,617,290 | A | 11/1952 | Schwartz | 70/452 |
| 2,623,959 | A | 12/1952 | Jarrett | 200/42 |
| 2,662,131 | A | 12/1953 | Cerna et al. | 200/44 |
| 2,683,978 | A | 7/1954 | Jacobi | 70/360 |
| 2,689,700 | A | 9/1954 | Drury | 248/27 |

(Continued)

OTHER PUBLICATIONS

"*Exhibit A*" A photograph of a Push Button Lock by Stratec that has a wide, thin rear end region, Existing since at least 2007.

*Primary Examiner* — Briggitte R Hammond
(74) *Attorney, Agent, or Firm* — David A. Burge

(57) ABSTRACT

A push button actuator unit has a housing that defines a passage extending along an axis. A push button assembly has components movable in the passage including a forwardly-biased push button at the front of the housing that is movable along and turnable about the axis. Two independently movable operating elements at the rear of the housing move differently in response to depression of the push button when the push button is turned to different orientations about the axis. The rear operating elements may extend concentrically along the axis, and the unit may be lockable to permit and prevent some operating element movement. The operating elements may be used to selectively disengage, or to engage and move a variety of auxiliary devices situated behind the unit. The unit may provide enhanced resistance to defeat by hammering than has been offered by a known form of push button unit.

24 Claims, 24 Drawing Sheets

U.S. PATENT DOCUMENTS 2,695,932 A 11/1954 Jacobi ..... 200/11
2,705,884 A 4/1955 Craig ..... 70/264
2,728,214 A 12/1955 Craig ..... 70/149
2,744,405 A 5/1956 McClelland ..... 70/81
2,755,519 A 7/1956 Xander ..... 20/52
2,772,908 A 12/1956 Craig ..... 292/280
2,911,247 A 11/1959 Corbin ..... 292/48
2,987,907 A 6/1961 Cockburn et al. ..... 70/135
3,003,348 A 10/1961 Jacobi ..... 70/84
3,054,634 A 9/1962 Westerdale ..... 292/336.3
3,111,833 A 11/1963 Dettmer ..... 70/140
3,146,010 A 8/1964 Dellith ..... 292/212
3,285,043 A 11/1966 Dauenbaugh et al. ..... 70/208
3,314,708 A 4/1967 Welch ..... 292/336.5
3,599,455 A 8/1971 Pilvet ..... 70/363
3,602,017 A 8/1971 Bauer ..... 70/78
3,964,280 A 6/1976 Kelton ..... 70/84
4,113,227 A 9/1978 Cigliano ..... 151/54
D265,965 S 8/1982 Davis et al. ..... D8/6
D270,328 S 8/1983 Davis et al. ..... D8/6
4,488,669 A 12/1984 Waters ..... 224/273
4,586,354 A 5/1986 Smith ..... 70/451
4,634,822 A * 1/1987 Goeke ..... 200/43.08
4,635,454 A 1/1987 Brown ..... 70/139
4,635,980 A 1/1987 DeLuca ..... 292/281
4,638,652 A 1/1987 Morse et al. ..... 70/454
4,640,478 A 2/1987 Leigh-Monstevens ..... 248/27.1
4,679,420 A 7/1987 Yang ..... 70/422
4,773,240 A 9/1988 Foshee ..... 70/222
4,794,772 A 1/1989 Falk et al. ..... 70/491
4,803,314 A 2/1989 Sorenson et al. ..... 200/11
4,899,561 A 2/1990 Myers ..... 70/208
4,912,951 A 4/1990 Weinerman et al. ..... 70/99
4,956,983 A 9/1990 Okamura et al. ..... 70/241
D312,769 S 12/1990 Bisbing ..... D8/338
4,978,152 A 12/1990 Bisbing ..... 292/169
5,018,373 A 5/1991 Weinerman et al. ..... 70/99
D318,217 S 7/1991 Weinerman et al. ..... D8/331
D324,635 S 3/1992 Weinerman et al. ..... D8/331
5,212,972 A 5/1993 Kincaid et al. ..... 70/208
5,308,126 A 5/1994 Weger, Jr. et al. ..... 292/53
5,617,749 A 4/1997 Park ..... 70/224
5,689,980 A 11/1997 Weinerman et al. ..... 70/208
5,711,506 A 1/1998 Stillwagon ..... 70/208
5,722,275 A * 3/1998 Price et al. ..... 70/379 R
5,730,014 A 3/1998 Berger et al. ..... 70/422
5,787,743 A 8/1998 Weigard ..... 70/422
5,799,520 A 9/1998 Laabs et al. ..... 70/360
5,816,630 A 10/1998 Bennett et al. ..... 292/341.17
D408,711 S 4/1999 Bianco ..... D8/331
5,901,836 A 5/1999 Taniuchi ..... 200/316
6,058,751 A 5/2000 Dimig et al. ..... 70/419
6,067,827 A 5/2000 Haseley et al. ..... 70/370
6,113,160 A 9/2000 Johansson et al. ..... 292/169
D431,998 S 10/2000 Johansson et al. ..... D8/331
D432,389 S 10/2000 Johansson et al. ..... D8/331
D433,309 S 11/2000 Johansson et al. ..... D8/331
D435,427 S 12/2000 Sokurenko ..... D8/331
D436,833 S 1/2001 Turner et al. ..... D8/331
6,231,091 B1 5/2001 Gleason et al. ..... 292/34
D445,015 S 7/2001 Weinerman et al. ..... D8/302
D447,042 S 8/2001 Weinerman et al. ..... D8/330
6,410,871 B1 * 6/2002 Rarbach ..... 200/336
6,425,275 B1 7/2002 Geurden ..... 70/422
D463,247 S 9/2002 Weinerman et al. ..... D8/330
6,454,320 B1 9/2002 Weinerman et al. ..... 292/56
D464,555 S 10/2002 Weinerman et al. ..... D8/330
6,463,774 B2 10/2002 Sokurenko ..... 70/360
D467,786 S 12/2002 Weinerman et al. ..... D8/330
6,501,037 B2 12/2002 Gressier et al. ..... 200/341
6,523,382 B1 2/2003 Dimig et al. ..... 70/496
D471,426 S 3/2003 Weinerman et al. ..... D8/330
D471,427 S 3/2003 Weinerman et al. ..... D8/330
D472,449 S 4/2003 Weinerman et al. ..... D8/330
D474,098 S 5/2003 Weinerman et al. ..... D8/330
D474,673 S 5/2003 Weinerman et al. ..... D8/330
6,564,602 B2 5/2003 Gregory ..... 70/360
6,575,503 B1 * 6/2003 Johansson et al. ..... 292/170
6,640,592 B2 11/2003 Vickers ..... 70/83
6,686,551 B2 2/2004 Pasotto ..... 200/566
6,711,924 B2 3/2004 Ritz ..... 70/422
6,755,449 B2 6/2004 Weinerman et al. ..... 292/198
6,782,725 B2 8/2004 Linares ..... 70/360
6,861,602 B2 3/2005 Juga ..... 200/341
6,978,645 B2 12/2005 Shimon ..... 70/379
7,126,066 B1 * 10/2006 Corcino et al. ..... 200/43.13
D532,674 S 11/2006 Schwalie et al. ..... D8/331
7,205,492 B1 4/2007 Corcino et al. ..... 200/43.13
7,406,847 B2 8/2008 Yuhi et al. ..... 70/360
7,472,570 B2 1/2009 Yamaguchi et al. ..... 70/379

* cited by examiner

PUSH BUTTON ACTUATOR

BACKGROUND OF THE INVENTION

The present invention relates to improvements in push button operating assemblies or push button actuators of the general type disclosed in U.S. Pat. Nos. 7,126,066 and 7,205,492 issued Oct. 24, 2006 and Apr. 17, 2007, respectively, referred to herein as the "Earlier Push Button Actuator Patents" or as the "EPBA Patents," the disclosures of which are incorporated herein by reference.

The push button actuators disclosed in the EPBA Patents each include a housing that defines a passage extending along a central axis, and a push button assembly having components that are movable in and near the passage including a forwardly-biased push button at the front of the housing that can be repositioned by moving it along the central axis between extended and depressed positions, and by turning it about the central axis between first and second orientations. Provided at the rear of the housing is a single operating element that does not turn about the central axis, but does move rearwardly along the central axis in response to depression of the front push button after being turned to the second orientation. Components enclosed in the housing of the actuator prevent the single rear operating element from moving rearwardly in response to depression of the front push button after being turned to the first orientation.

A significant advantage offered by push button actuator units of the type described above and disclosed in detail in the EPBA Patents is that these units have proven to be extremely rugged and reliable, even when employed in abusive environments (for example to engage, move and operate an auxiliary device such as an actuator rod that, when moved, causes components of a plural-point locking system to lock and unlock as desired to secure large toolboxes and containers that are left overnight, sometimes for days at a time, at building remodeling or erection worksites to protectively house large power tools, fixtures awaiting installation, supplies and the like).

A disadvantage inherent in the design of push button actuator units of the type disclosed in the EPBA Patents is the limited control capability these units offer. Each has only a single rear operating element that is biased forwardly and permitted to move rearwardly only when the front push button is depressed while turned to a specific orientation (typically an "unlocked" orientation). No axial movement of any rear operating element takes place when the front push button is depressed while turned to a different orientation (typically a "locked" orientation); and the rear operating element is prevented from turning about the axis regardless of how the front push button may be turned or oriented or moved axially.

Stated in another way, because a push button actuator unit of the type disclosed in the EPBA Patents has only one rear operating element, because the one and only rear operating element is prevented from turning in response to turning of the front push button, and because no provision is made for any type of axial movement of a rear operating element in response to depression of the front push button when turned to one of two possible orientations (namely a "locked" orientation), a push button actuator unit of the type disclosed in the EPBA Patents effectively ignores and entirely discards a number of push button positionings and/or movements that perhaps might be put to good use if a way could be found to modify the design to transmit characteristics of the unused and ignored positionings and/or movements of the front push button through the housing passages of such units to rear locations where these characteristics might perhaps be utilized by a plurality of independently movable rear operating elements to control one or a plurality of auxiliary devices situated near the rear of or behind push button actuator units of the type disclosed in the EPBA Patents.

What is needed is a push button actuator that implements a more versatile control capability without discarding or diminishing the abuse-resistant character of the push button actuator design that is disclosed in the Earlier Actuator Patents which results at least in part from providing a rear operating element that is segregated and isolated from forces that may be applied to front portions of the housing and/or other frontal components of the units by a well designed housing that carries a transversely extending disc which effectively divides a passage that extends through the housing into front and rear regions where different activities occur, and has other features and characteristics that are disclosed in the EPBA Patents.

SUMMARY

The present invention takes into account the advantages, disadvantages, strengths and weaknesses of the prior art as described above, by providing push button actuator units having an enhanced control capability while still utilizing the rugged design characteristics afforded by push button actuator units of the type described in the referenced EPBA Patents.

What the present invention seeks to accomplish (without diminishing the well appreciated capabilities of push button actuators of the type disclosed in the EPBA Patents) is to significantly enhance the control capabilities and versatility of these units by providing them with plural rear operating elements capable of being utilized in a variety of ways to selectively operate a plurality of auxiliary devices by selectively engaging, moving and operating actuator members situated to the rear of the units whereby the simple use of a depressable push button that can be turned to various orientations can be employed to achieve results far beyond the capability for which push button actuator units of this type were initially designed and thought to be capable of providing.

In one form, what the present invention offers is a feature enriched push button actuator unit having a far greater range of control capability than a prior art form of the actuator, by providing at the rear of the unit a plurality of operating elements each being independently movable and each being capable of selectively disengaging, or engaging and moving separate auxiliary devices situated near the rear of or behind the unit—so that different rear operating element movements and positionings are obtained as the result of turning the front push button, and as the result of depressing the front push button when turned to different orientations.

In one form, a push button actuator is provided with a pair of rear operating elements capable of responding differently to depression of a front push button when turned to different orientations, with at least one of the rear operating elements also having the ability to turn in response to turning of the front push button about the unit's central axis.

In one form, a push button actuator is provided that has a depressable push button turnable between first and second orientations, and has first and second concentrically arranged and rearwardly extending operating elements that move rearwardly independently of each other with one extending rearwardly beyond the other in response to depression of the push button when turned to the first orientation, and with the other extending rearwardly beyond the one in response to depression of the push button when turned to the second orientation.

In the form just described, a) the second operating element may surround the first operating element and may be configured to align with, engage and operate an auxiliary device only when the push button is depressed while turned to the second orientation, and b) the second operating element may be prevented from moving rearwardly in response to depression of the push button when turned to the first orientation.

In another form of the invention, a push button actuator having a housing has a forwardly biased push button located at the front of the housing that is depressable rearwardly along an axis of a passage that extends forwardly-rearwardly through the housing, and first and second operating elements are provided at the rear of the housing, with the first operating element being movable to extend farther rearwardly from the housing than the second operating element in response to depression of the push button while turned about the axis to a first orientation, and with the second operating element being movable to extend farther rearwardly from the housing than the first operating element in response to depression of the push button while turned about the axis to a second orientation different than the first orientation.

In the form just described, the push button actuator may include a lock mechanism having a keyway into which a key can be inserted and turned about the axis to the first orientation to cause the lock mechanism to prevent the rearward movement of the second operating element, and to the second orientation to cause the lock mechanism to permit the rearward movement of the second operating element, with the lock mechanism also being adapted to permit key insertion into and key removal from the keyway only when turned about the axis to the first and second orientations.

In another form, a push button actuator provides a housing having a passage extending forwardly-rearwardly therethrough along a central axis, and having components movable along the central axis including a) a forwardly-biased front push button movable along the central axis between an extended position projecting forwardly from the passage and a depressed position protectively nested in a front part of the passage, b) a lock mechanism in the front push button defining a keyway that can be turned by a key inserted into the keyway between locked and unlocked orientations about the central axis, c) first and second rear operating elements extending rearwardly from the passage along the central axis, d) with only the first rear operating element being adapted to move rearwardly in response to the front push button being moved rearwardly to the depressed position at a time when the keyway is turned to the locked orientation, and with the second rear operating element being adapted to move rearwardly in response to the front push button being moved rearwardly to the depressed position at a time when the keyway is turned to the unlocked orientation. The first and second rear operating elements may extend concentrically along the central axis with a portion of the second rear operating element surrounding and protectively shrouding a portion of the first rear operating element.

In another form, a push button actuator includes a housing having a passage extending forwardly-rearwardly therethrough along a central axis; and a push button assembly movable along the central axis including i) a forwardly biased push button near a front end of the passage that can be depressed from a normally extended position to a depressed position and can be turned between first and second orientations, and ii) inner and outer operating elements near a rear end of the passage that extend one about the other and are adapted to move relative to each other differently when the push button is depressed while turned to the first orientation than when the push button is depressed while turned to the second orientation.

In still another form, a push button actuator has a housing that defines a passage extending forwardly-rearwardly therethrough along a central axis about which a forwardly biased push button at the front of the passage and inner and outer concentrically arranged operating elements at the rear of the passage are drivingly connected to turn in unison, with the inner rear operating element being movable rearwardly along the axis in unison with the push button when the push button is depressed while turned about the axis to one orientation, and with the outer rear operating element being movable rearwardly along the axis in unison with the push button when the push button is depressed while turned about the axis to an orientation different than the one orientation.

In the form just described, first and second actuator members may be situated behind the push button, with the first actuating member being positioned to be engaged and moved by the outer rear operating member when moved rearwardly along the central axis, and with the second actuator member being positioned to be engaged and moved by the inner rear operating member when moved rearwardly along the central axis.

Enhanced control capabilities can be provided in units that embody the present invention by utilizing the turning of the front push button to different orientations to operate auxiliary devices situated along opposite sides of rear regions of the push button actuator where these devices can be engaged and operated by the turning of a rear operating element; by utilizing depression of the front push button when turned to different orientations to cause independent movements of rear operating elements to operate auxiliary devices located behind the push button actuator; and by using momentary and maintained depression characteristics of the push button actuator that can be provided when the push button is depressed while turned to different orientations to cause momentary and maintained operation of auxiliary devices situated to the rear of the push button actuator unit where these devices preferably are engaged by selected ones of the rear operating elements when the front push button is depressed while turned to different orientations.

DESCRIPTION OF THE DRAWINGS

These and other features, and a fuller understanding of the invention may be had by referring to the following description and claims taken in conjunction with the accompanying drawings, wherein:

DETAILED DESCRIPTION

Figure 13:
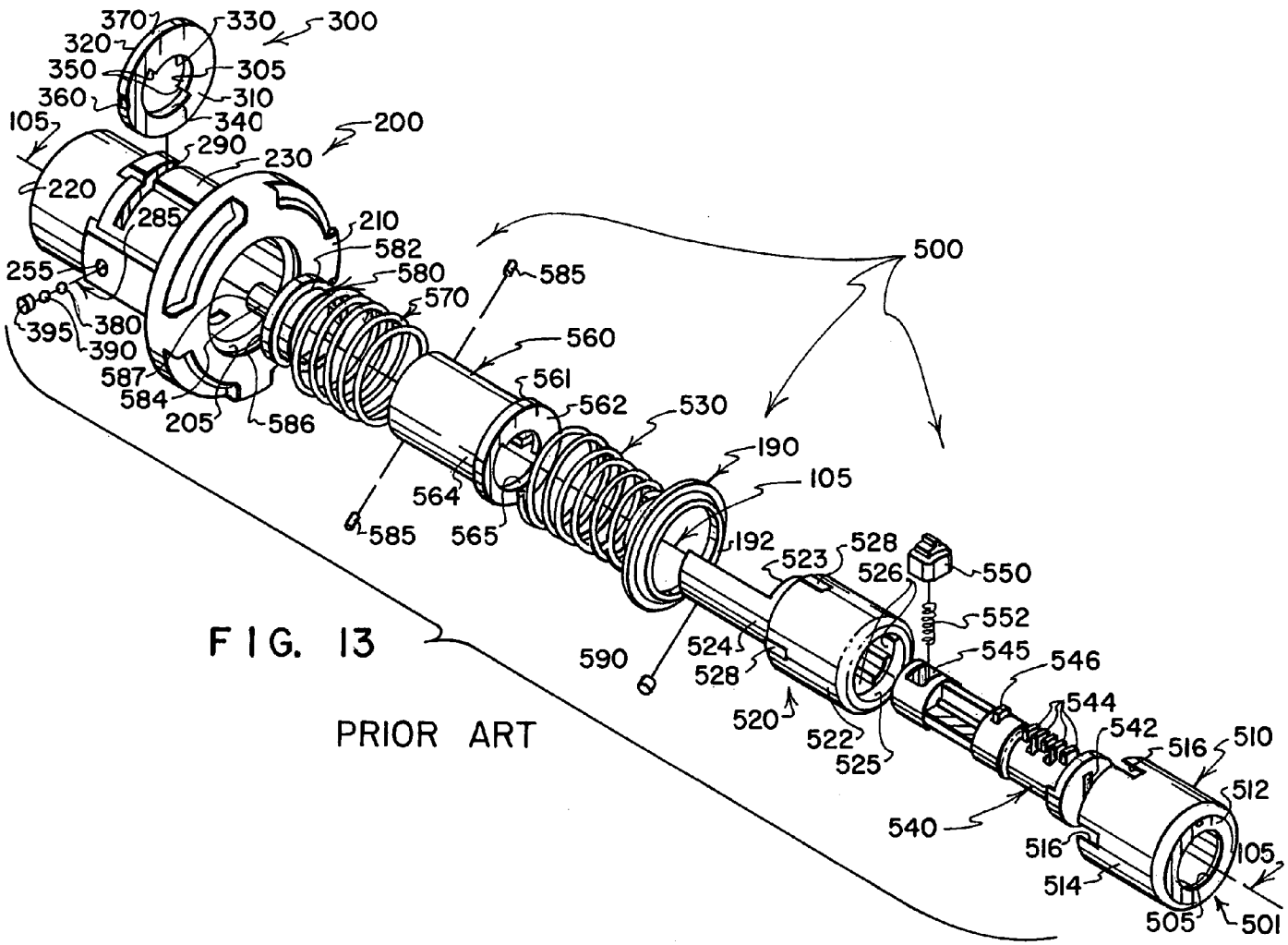
FIG. 13 PRIOR ART
FIG. 13 is an exploded perspective view of components of the prior art push button actuator unit of the EPBA Patents that is shown in FIGS. 1-12.
Figures 14, 15:
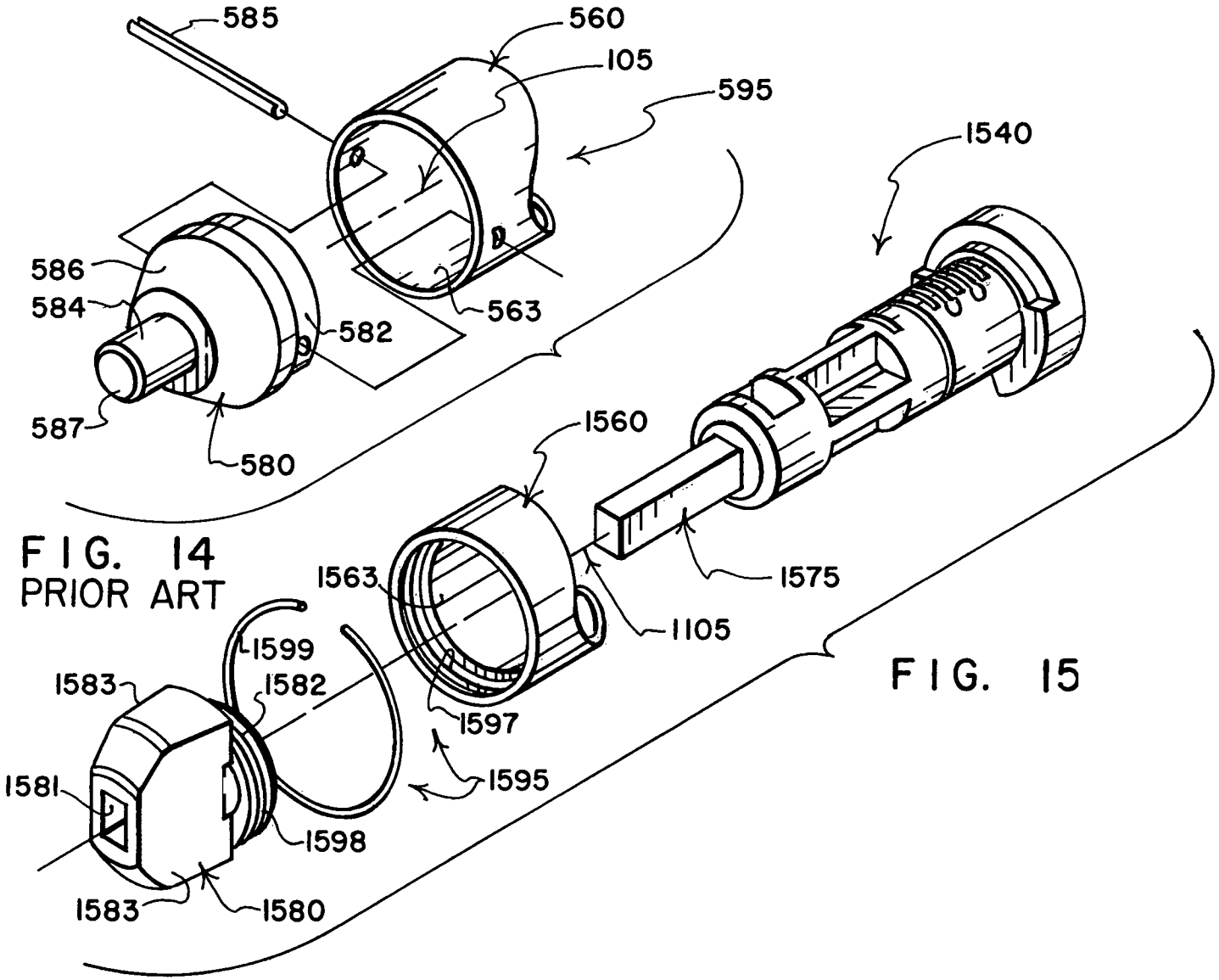
FIG. 14 PRIOR ART
FIG. 14 is an exploded perspective view showing on an enlarged scale parts of the plunger-type rear operating element of the prior art actuator unit of FIGS. 1-13.
FIG. 15 is an exploded perspective view on an enlarged scale showing components that replace the components of FIG. 14 in an enhanced form of push button actuator unit that embodies features of the present invention.

In the accompanying drawings, FIGS. 1-12 show a prior art push button actuator unit 100 of the type disclosed in the referenced EPBA Patents. FIGS. 13 and 14 show selected components of the prior art actuator 100, and FIG. 15 shows selected components utilized in an enhanced form of push button actuator unit 1000, features of which are depicted in FIGS. 16-32. Lastly, FIGS. 33-36 are schematic illustrations showing how rear operating elements of an enhanced push button actuator unit may be utilized in various ways to move actuators or to operate auxiliary devices 50, 60, 70, 80 and 90.

In the drawings, the numerals 500, 1500 designate what are referred to as push button assemblies of the actuator units 100, 1000, respectively. Some components of the push button assemblies 500, 1500 are turnable about central axes 105, 1105 of the actuator units 100, 1000 in response to suitably configured keys (not shown) being turned about the axes 105, 1105 after being inserted into keyslots or keyways 542, 1542 of the actuator units 100, 1000, respectively.

Where the numerals 501, 1501 appear in the drawings, and where the term "pushbutton" is used in the this document, what is designated by the numerals and referred to in the text are such components of the push button assemblies 500, 1500 as actually turn about the axes 105, 1105 in response to suitably configured keys being turned about the axes 105, 1105 after being inserted into the keyways 542, 1542 of the actuator units 100, 1000, respectively. The term "pushbutton" as used herein is also defined to include depressable components of the pushbutton assemblies 500, 1500 that may not turn, but do move along the axes 105, 1105 when turnable components of the push button assemblies 500, 1500 are caused to move along the axes 105, 1105 as, for example, when depressed from such positions shown in FIGS. 16 and 25 to positions shown in FIGS. 20 and 28. It is therefore correct to say that the push buttons 501, 1501 are repositionable both by moving along the axes 105, 1105, and by turning about the axes 105, 1105 (even though not every one of the components that are included in the term "pushbutton" may actually be designed to turn about the axes 105, 1105).

Because the enhanced push button actuator unit 1000 preferably is assembled from many of the same components that are used to assemble the prior art push button actuator unit 100, FIGS. 15-32 (which depict features of the enhanced actuator unit 1000) utilize many of the same 3-digit numerals that are employed in FIGS. 1-14 (which depict features of the prior art actuator unit 100). In FIGS. 15-36, all 3-digit numerals designate components that are common to the prior art actuator unit 100 of the EPBA Patents, and all 4-digit numerals employed in the drawings designate components that are unique to the enhanced push button actuator unit 1000.

In many instances, the 4-digit numerals utilized herein in conjunction with components of the enhanced push button actuator unit 1000 designate components of the enhanced actuator unit 1000 that correspond in character, function and/or operation to components of the original push button actuator unit 100 which are designated by corresponding 3-digit numerals (that differ from the 4-digit numerals by a magnitude of one thousand). As examples, a primary rear element of the actuator unit 1000 that is designated by the numeral 1560 corresponds to a primary rear element of the actuator unit 100 that is designated by the numeral 560; the push button assembly of the unit 1000 that is designated by the numeral 1500 corresponds to the push button assembly of the unit 100 that is designated by the numeral 500; and, the push button 1501 of the unit 1000 corresponds to the push button 501 of the unit 100. This use of corresponding 4-digit and 3-digit numerals in conjunction corresponding components of the units 1000, 100, respectively, minimizes the need to repeat much of the detailed description of components of the unit 100 that is equally applicable to corresponding components of the unit 1000.

The Prior Art Actuator Unit 100

Referring to FIGS. 1-12, the prior art push button actuator unit 100 has a tubular housing 200, front and rear surfaces of which are indicated by the numerals 210, 220, respectively. An internal passage 205 extends centrally through the housing 200 along an imaginary central axis 105, and opens through the front and rear surfaces 210, 220.

The housing 200 has a complexly configured exterior defined in large measure by an outer surface 230 that extends between the front and rear surfaces 210, 220. Included among exterior formations of the housing 200 that are bounded by the outer surface 230 are a substantially annular front bezel 260, a substantially cylindrical rear portion 270, and a central portion 280 situated between the front bezel 260 and the rear portion 270.

A relatively thin slot 290 is formed in the central portion 280 of the housing 200 and opens through the housing's outer surface 230. The slot 290 extends in an imaginary plane that transversely (i.e., substantially perpendicularly) intersects the central axis 105; and, the slot 290 opens upwardly through the outer surface 230.

Figure 19:
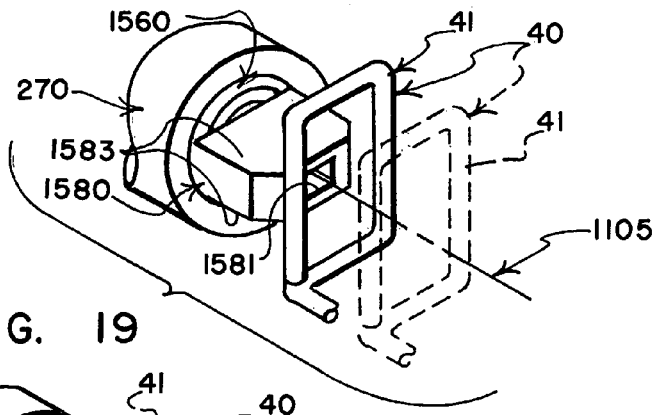
FIG. 19 is a perspective view showing a portion of the rear end region of the unlocked and non-operated actuator unit of FIGS. 16-18 with the rectangular loop of the actuator rod shown by solid lines in its non-operated position and by broken lines in its rearwardly moved operated position.
Figure 21:
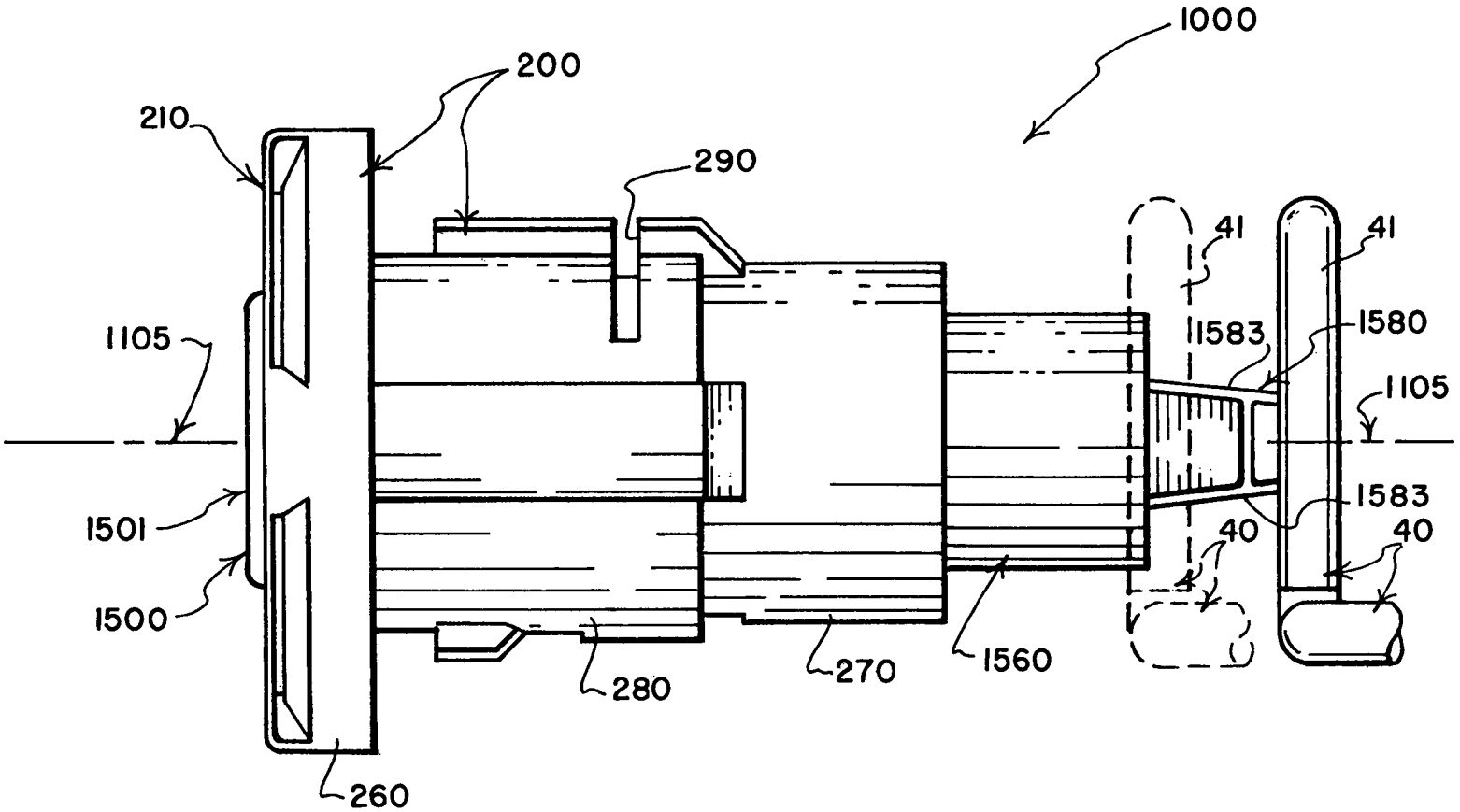
FIG. 21 is a right side elevational view of the unit of FIG. 20 with components thereof in the same positions as in FIG. 20, and showing the rectangular loop of the actuator rod in solid lines in its operated position to which it moved in response to depression of the front push button which causes the outer rear operating element to engage and rearwardly move the rectangular loop, and with the non-operated position of the actuator rod loop depicted by broken lines.

As can be seen in FIGS. 2, 3, 5, 6, 8, 9, 11 and 12, the slot 290 crosses the central passage 205 of the housing and serves to house and support a disc-shaped member 300, the preferred configuration of which is best seen in FIG. 13 (and in FIGS. 19 and 21 of the EPBA Patents). Referring to FIG. 13 (and to FIGS. 19 and 21 of the EPBA Patents), the disc-shaped member 300 is substantially flat, having opposed front and rear surfaces 310, 320 that extend in spaced, substantially parallel planes. The width of the slot 290 and the thickness of the disc-shaped member 300 are selected to provide a slip fit mounting in the slot 290 of the disc-shaped member 300 that permits the disc-shaped member 300 to turn in the slot 290 about the central axis 105.

Referring still to FIG. 13, a central opening 305 is formed through the disc-shaped member 300. When the disc-shaped member 300 is properly positioned in the slot 290, the opening 305 aligns with and communicates with the central passage 205 of the housing 200 so that elements of a push button assembly 500 can move along the central axis 105 through portions of the aligned passage 205 and opening 305.

Referring to FIG. 13 (and to FIGS. 19, 21 and 22 of the EPBA Patents), the central opening 305 of the disc-shaped member 300 is defined by a pair of substantially semi-circular, substantially C-shaped surfaces 330, 340 that are of unequal radii. The C-shaped semi-circular surface 330 has a radius of curvature that is smaller than the radius of curvature of the C-shaped semi-circular surface 340. Flat surfaces 350 extending substantially radially with respect to the central axis connect adjacent end regions of the C-shaped surfaces 330, 340. In essence, the C-shaped surfaces 330, 340 divide the opening 305 into a smaller "half" bounded by the small-radius curved surface 330, and a larger "half" bounded by the large-radius curved surface 340.

Referring to FIG. 13 (and to FIGS. 21 and 22 of the EPBA Patents), the reason why the central opening 305 of the disc-shaped member 300 is configured in the manner just described is to enable the opening 305 to provide exterior or "female" elements of a spline-type connection that is used to drivingly connect the disc-shaped member 300 to two major elements of the push button sub-assembly 500, namely a primary front element 520 and a primary rear element 560.

The primary front element 520 has a generally cylindrical front portion 522, and a rearwardly extending substantially C-shaped rear portion 524 that is sized to be received in a slip fit within the larger "half" of the opening 305 of the disc-shaped member 300. The primary rear element 560 has a substantially annular front flange 562 with an outer diameter that is received in a slip fit within front portions of the housing passage 205, but which is too large to pass through a rear end region of the housing passage 205 where a smaller diameter opening 284 (see FIGS. 3, 6, 9 and 12) is defined by a rear wall 285 of the housing 200.

An opening 565 is formed centrally through the front flange 562 of the primary rear element 560. The opening 565 is substantially the same size and shape as the opening 305 formed through the disc-shaped member 300. Because the openings 305, 565 are identical, the opening 565 and can be thought of as having smaller and larger "halves" just as does the opening 305—an arrangement that permits each of the oddly configured openings 305, 565 to define external or "female" portions of a spline-type connection that drivingly connects the components 300, 520, 560.

The C-shaped cross-section of the rear portion 524 of the primary front element 520 is sized and configured to be received in a slip-fit inside the larger "halves" of the identically shaped openings 305, 565 of the components 300, 560. This permits the rear portion 524 to serve as the interior or "male" element of the spline-type connection that drivingly connects the components 300, 520, 560. The resulting spline-type connection accomplishes two objectives, namely 1) to connect the components 300, 520, 560 in a way that permits the spline-connected members 300, 520, 560 to translate freely along the central axis 105 relative to each other, and 2) to connect the components 300, 520, 560 in a manner ensuring that, if any one of the spline-connected members 300, 520, 560 is caused to turn about the central axis 105, all three of the spline-connected members 300, 520, 560 will be forced to turn in unison about the axis 105.

The use of spline-type connections between or among a plurality of components 1) to permit the spline-connected components to slide axially (i.e., to translate along an axis of the components) relative to each other, and 2) to prevent the spline-connected components from turning relative to each other (about the same axis along which the spline-connected components are permitted to translate) constitutes a mechanism and a technique that is well known to those who are skilled in the art. Also well known is the fact that spline-type connections can be established by employing components that have a wide variety of interfittable, slide-together formations. Thus it will be readily understood that the members 300, 520, 560 can be spline-connected by slide-together formations that differ in configuration from the formations that are disclosed herein, so long as the formations selected for use provide freely slidable connections that permit axial translation relative to each other of the spline-connected components 300, 520, 560 while also serving to minimize or eliminate relative turning of the spline-connected components 300, 520, 560 about the same axis along which the spline-connected components 300, 520, 560 can translate.

Elements of the push button actuator unit 100 that are employed by the push button assembly 500 are depicted in FIG. 13. These elements include the primary front element 520, the primary rear element 560, a front cover element 510 designed to fit closely over and to shroud much of the exterior of the cylindrical front portion 522 of the primary front element 520, a front spring element 530, a tumbler-carrying, keyway-defining plug 540 which defines a transversely extending passage 545 in which a transversely movable latch bolt 550 and a spring 552 are carried, a rear spring element 570, a rear plunger element 580, a pair of connecting pins 585 insertable into aligned holes of the primary rear element 560 and the rear plunger element 580 to connect the elements 560, 580, and a pin 590 (see FIG. 13 and FIGS. 21, 22 of the EPBA Patents) having an inner end configured to be inserted into a hole 529 (see FIG. 22 of the EPBA Patents) formed through the rear portion 524 of the primary front element 520, and an outer end configured to extend in a slip-fit into an axially extending slot 569 (see FIG. 22 of the EPBA Patents) of the primary rear element 560 to connect the elements 520, 560 for translation along the axis 105 relative to each other through a limited range of movement which causes the outer end of the pin 590 to move along the length of the slot 569.

Referring to FIG. 13, the front cover element 510 preferably is formed from a material that exhibits a distinctive color which causes depressable front portions of the push button assembly 500 to present a prominent appearance. The front cover element 510 has an annular front portion 512 with an opening 505 formed therethrough which is of sufficient size to provide unobstructed access to a keyway 542 defined by the tumbler-carrying plug 540 designed to be inserted into central passage 525 of the primary front element 520, and has a generally cylindrical portion 514 designed to closely overlie and shroud the cylindrical front portion 522 of the primary front element 520. The generally cylindrical portion 514 provides a smooth outer surface 515 (best seen in FIGS. 2, 7 and 8) except where notches 516 are provided near the rear of the cylindrical portion 514 to engage projections 528 that are provided near the rear of the rear portion 524 of the primary front element 520. When the cover element 510 is installed on the front portion 522 of the primary front element 520, the front cover element 510 is prevented from turning about the axis 105 relative to the primary front element 520 by the projections 528 (see FIG. 13) extending into the notches 516.

When elements of the push button assembly 500 are installed in the passage 205 of the housing 200, the smooth outer surface 515 of the front cover element 510 is engaged by a resilient wiper-washer 190 which serves as a seal to prevent moisture, dirt, dust and debris from entering interior portions of the passage 205. As is shown in FIGS. 2, 3, 5, 6, 8, 9, 11 and 12, the housing 200 is provided with an annular groove 195 that opens into front portions of the passage 205 that supports the resilient wiper-washer 190. When installed in the groove 195, the a forwardly extending lip 192 of the wiper-washer 190 engages the smooth outer surface 515 of the front cover element 510 of the push button assembly 500.

Referring to FIGS. 3, 6, 9 and 12, the primary front element 520 of the push button assembly 500 defines an annular, rearwardly-facing recess 521 designed to receive front portions of the front spring element 530. Other portions of the front spring element 530 surround the C-shaped cross-section of the rear portion 524 (FIG. 13) of the primary front element. A rear portion of the front spring element 530 engages the front face 310 of the disc-shaped member 300.

Referring to FIG. 13 (and to FIGS. 20-22 of the EPBA Patents), a rearwardly-facing stop surface 523 is defined by the primary front element 520 near the front end of the C-shaped cross-section of the rear portion 524. When front elements of the push button assembly 500 are depressed rearwardly along the central axis 105, the stop surface 523 may be caused to engage the front surface 310 of the disc-shaped member 300 to "stop" rearward translation of the primary front element 520. Because the disc-shaped member 300 is of sturdy construction and has much of its periphery nested in and securely supported by portions of the housing 200 that define the transversely extending slot 290, the engagement of the stop surface 523 of the primary front element 520 with the front face 310 of the disc-shaped member 300 provides a very secure means of "stopping" the rearward depression of front elements of the push button assembly 500—a simple arrangement that is highly resistant to hammering of front elements of the push button assembly 500 if attempts are made to defeat or break the push button actuator unit 100 by hammering front elements of the push button assembly 500.

Figure 3:
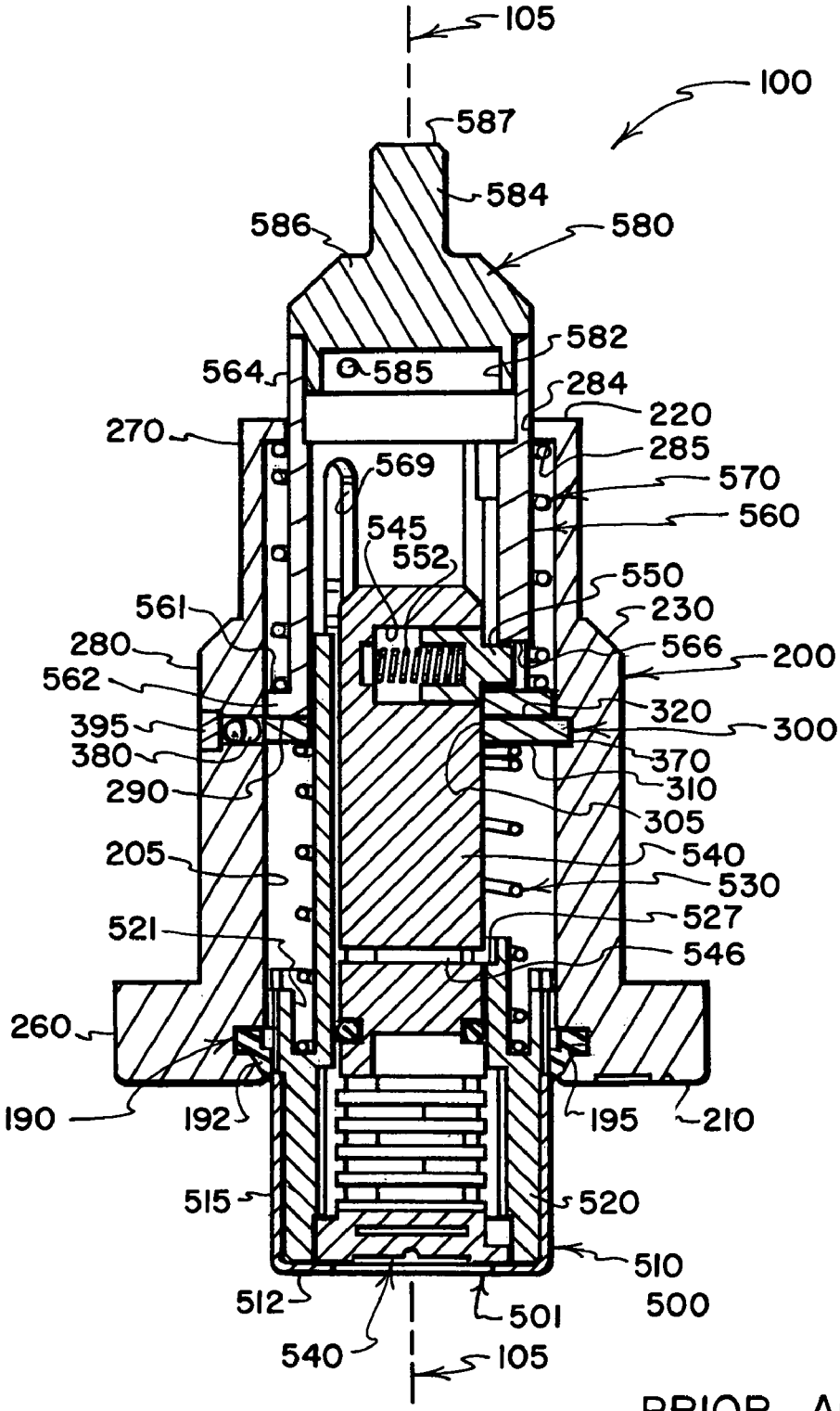
FIG. 3 PRIOR ART
FIG. 3 is a sectional view as seen from a plane indicated by a line 3-3 in FIG. 1.

Referring to FIGS. 3, 6, 9 and 12 in conjunction with FIG. 13, the rear plunger element 580 has a generally cylindrical forwardly-extending front portion 582, a relatively small diameter rearwardly-extending rear portion 584 that defines a rear engagement surface 587, and a central portion 586 configured to connect the front and rear portions 582, 584. The front portion 582 of the rear plunger element 580 is inserted into the open rear end region of a generally cylindrical rear portion 564 of the primary rear element 560, and is held in place by one or more connecting pins 585 installed in aligned holes formed through the front portion 582 and through the rear portion 564 (FIG. 3).

The rear engagement surface 587 of the rear plunger element 580 is provided for the purpose of engaging an operating element (not shown) of a device that is to be operated by the push button actuator unit 100 (or that is to have its operation initiated by or influenced by the push button actuator unit 100) when "unlocked" elements of the push button assembly 500 are depressed to move the engagement surface 587 rearwardly (so as to cause an operating element to move from one position to another). Operating elements typically moved from one position to another by push button actuator units (such as an operating element of a latch, or an element that causes a set of latches to release so an associated closure can open) are well known to those who are skilled in the art, as is exemplified by the mechanisms depicted in patents assigned to The Eastern Company that include U.S. Pat. Nos. 6,755,449, 6,543,821, 6,454,320, D-474,673, D-472,449, D-471,427, D-471,426, D-467,786, D-464,555, D-463,247 and D-447,042, the disclosures of which are incorporated herein by reference.

Referring to FIGS. 3, 6, 9 and 12, the rear spring element 570 extends about the cylindrical rear portion 564 (FIG. 3) of the primary rear element 560. Front portions of the rear spring element 570 engage a rearwardly-facing surface 561 (see FIG. 13 and FIGS. 21, 22 of the EPBA Patents) of the annular front flange 562 of the primary rear element 560. Rear portions of the rear spring element 570 engage a forwardly facing annular interior surface of the back wall 285 of the housing 200. By this arrangement, the rear spring element 570 is positioned to bias the primary rear element 560 (and the rear plunger element 580 which is rigidly connected to the primary rear element 560 by the pins 585) forwardly toward a non-operated position depicted in FIGS. 3 and 9—a position wherein the front surface of the annular front flange 562 of the primary rear element 560 engages the rear surface 320 of the disc-shaped member 300 to "stop" forward movement of the primary rear element 560.

Rearward movement of the primary rear element 560 is stopped before the rear spring element 570 is compressed to an undesired degree by a threaded fastener 590 which has an inner end region that is threaded into a hole 529 (see FIG. 22 of the EPBA Patents) formed through the rear portion 524 of the primary front element 520, and which has an outer end region (an enlarged head of the fastener 590) that is received in a slip-fit within an axially extending slot 569 (see FIG. 22 of the EPBA Patents) defined by the primary rear element 560. When the outer end region of the fastener 590 comes into engagement with one of the curved end surfaces of the slot 569, rearward movement of the primary rear element 560 is "stopped."

Referring to FIG. 13, the tumbler-carrying, keyway-defining plug 540 is an elongate member that has a conventionally configured front portion which, in a conventional manner well known to those who are skilled in the art, defines a keyway 542 that opens forwardly to receive a suitably configured key (not shown), and that provides transversely extending slots which carry a set of spring biased tumblers 544 configured in a conventional manner to engage portions of a key inserted into the keyway 542. A properly configured key inserted into the keyway 542 will retract the tumblers 544 in the usual and conventional manner from extending into grooves 526 (see FIGS. 19, 22 of the EPBA Patents) defined in the usual way along interior portions of the passage of a surrounding structure (in this case the passage 525 of the primary front element 520) so the plug 540 can turn between so-called "locked" and "unlocked" positions (in this case, the plug 540 turns about the axis 105 to orient the keyway either in an unlocked direction depicted in FIGS. 1-6, or in a locked direction depicted in FIGS. 7-12).

Figure 4:
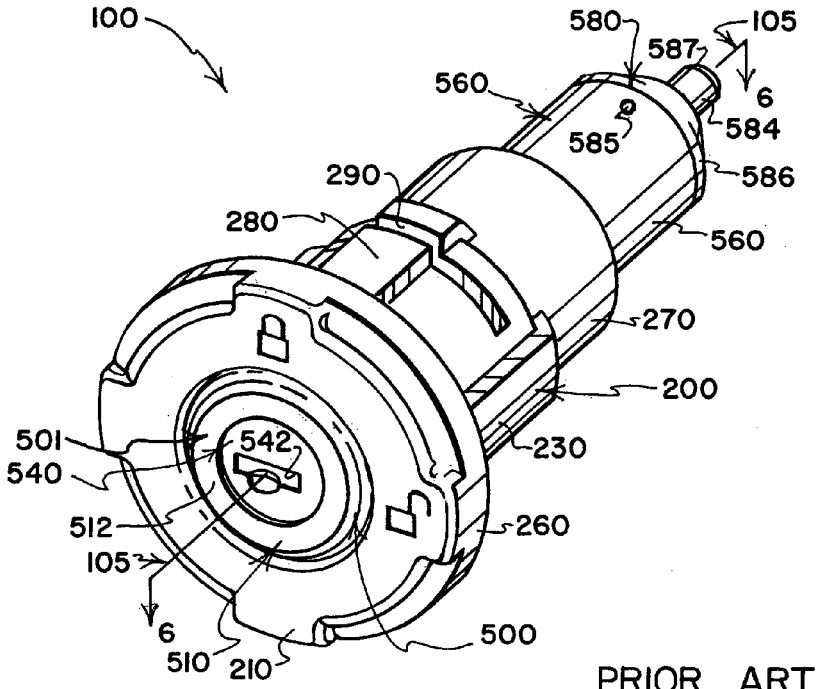
PRIOR ART FIG. 4
FIG. 4 is a perspective view similar to FIG. 1 but with the unlocked push button depressed causing the rear plunger portion of the push button to project rearwardly to an extended, operated position.
Figure 5:
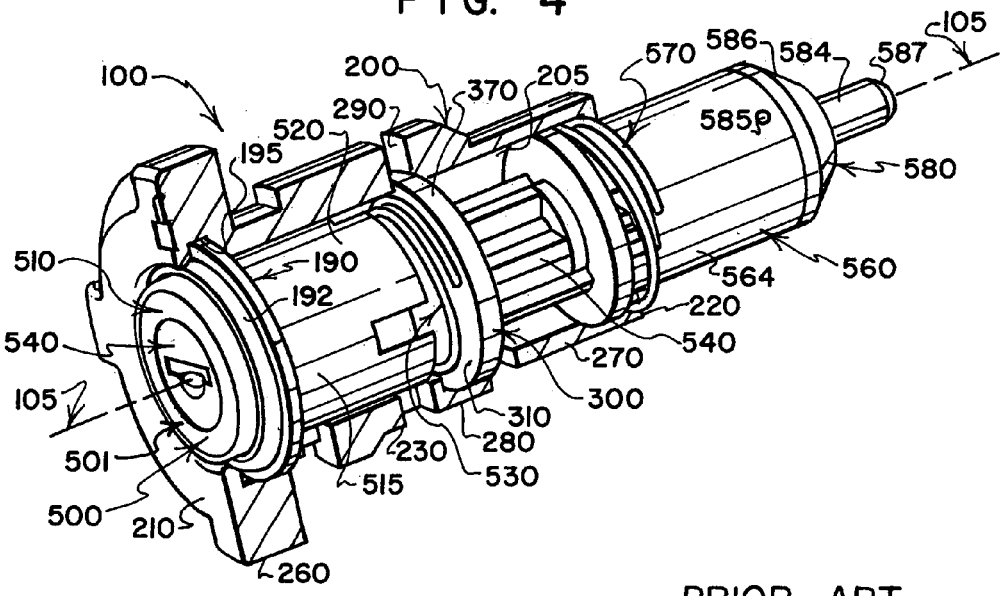
PRIOR ART FIG. 5
FIG. 5 is a perspective view thereof with portions broken away and shown in cross-section.
Figure 6:
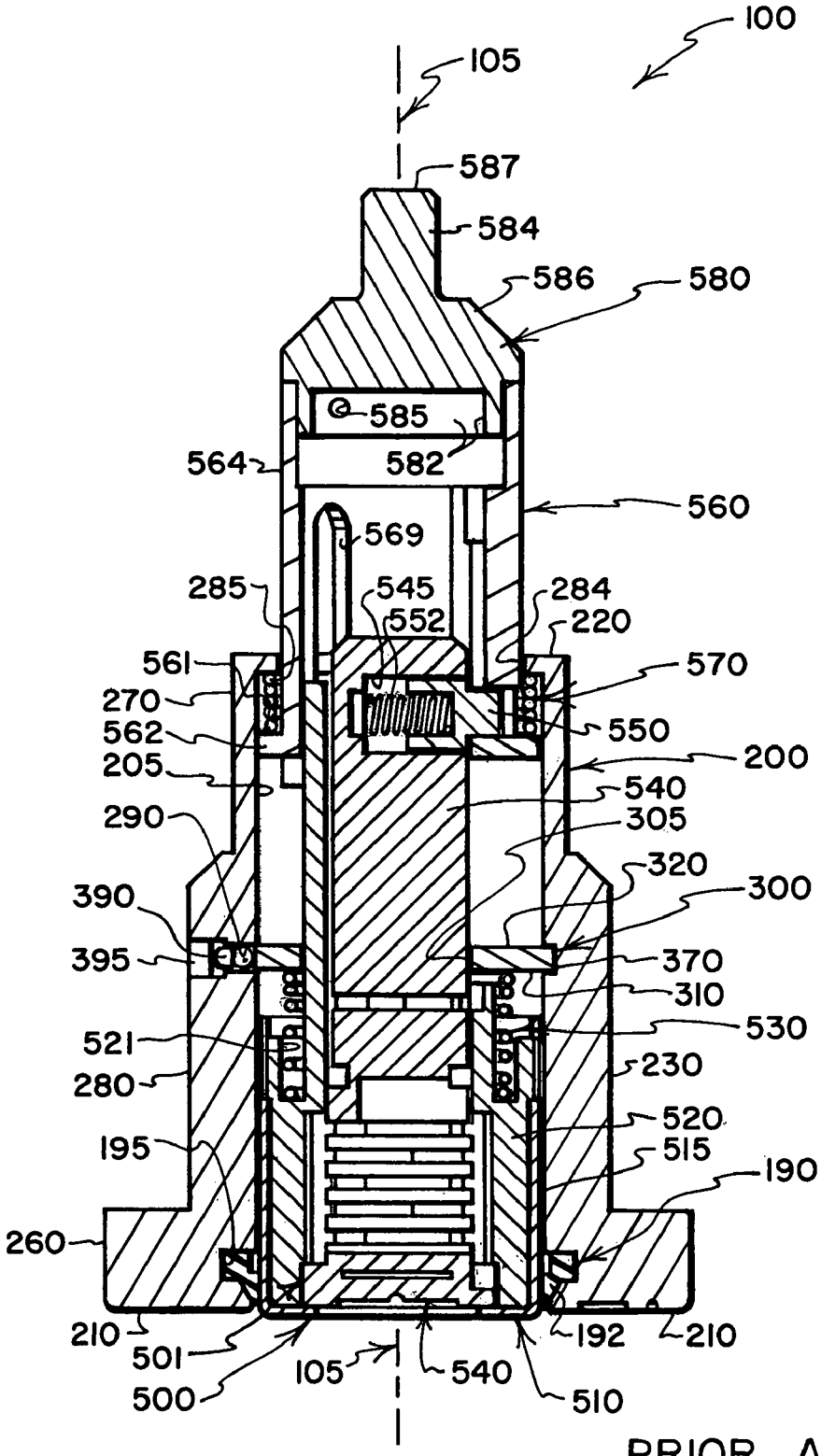
FIG. 6 PRIOR ART
FIG. 6 is a sectional view as seen from a plane indicated by a line 6-6 in FIG. 4.

When the plug 540 is turned to put the keyway 542 in the unlocked orientation depicted in FIGS. 1-6, the bolt 550 carried by the plug 540 is oriented as depicted in FIG. 3 (where front portions of the push button assembly 500 are in their normal, forwardly extended, non-depressed positions) or as depicted in FIG. 6 (where front portions of the push button sub-assembly 500 are shown in their depressed positions). Because the plug 540 is "unlocked" as depicted in FIGS. 3 and 6, the spring-projected bolt 550 does nothing to "latch" any of the elements of the push button sub-assembly 500 to prevent their forward or rearward movement along the axis 105.

Figure 7:
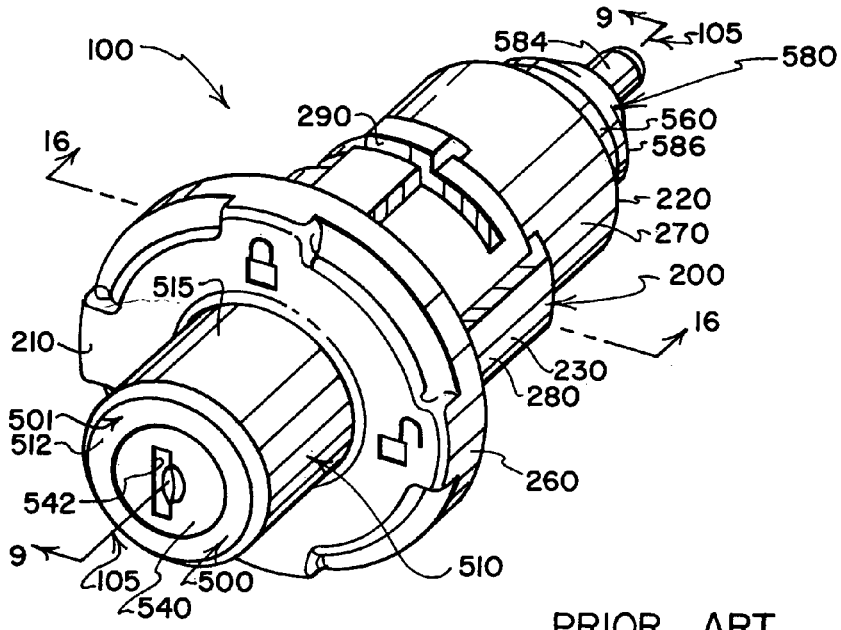
FIG. 7 PRIOR ART
FIG. 7 is a perspective view similar to FIG. 1 but with the keyway of the push button turned to a locked orientation, it being seen that the push button has not been depressed, and that the rear plunger type operating element is therefore in its normal non-extended and non-operated position.
Figure 8:
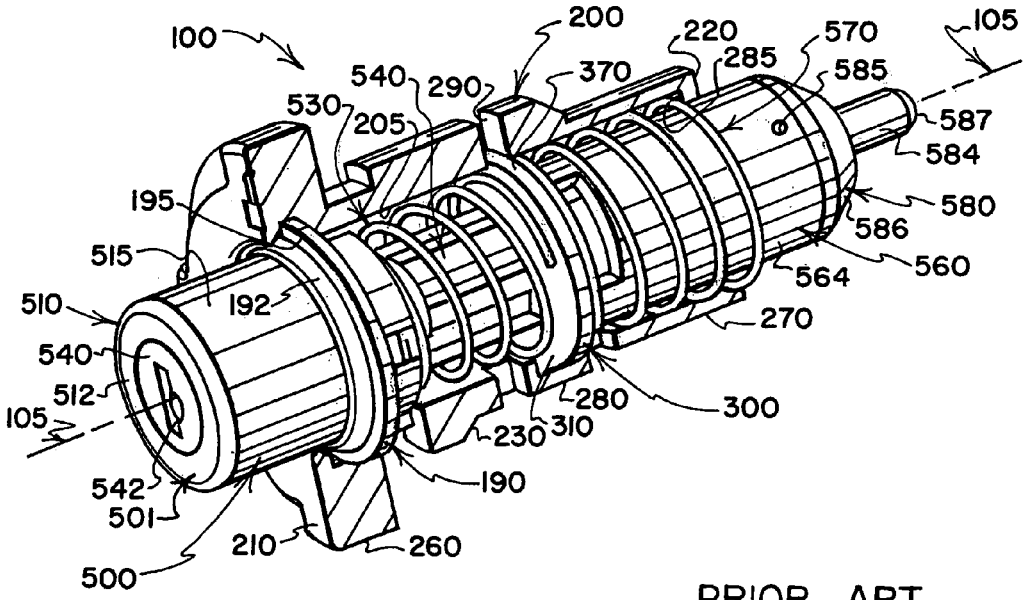
FIG. 8 PRIOR ART
FIG. 8 is a perspective view thereof with portions broken away and shown in cross-section.
Figure 9:
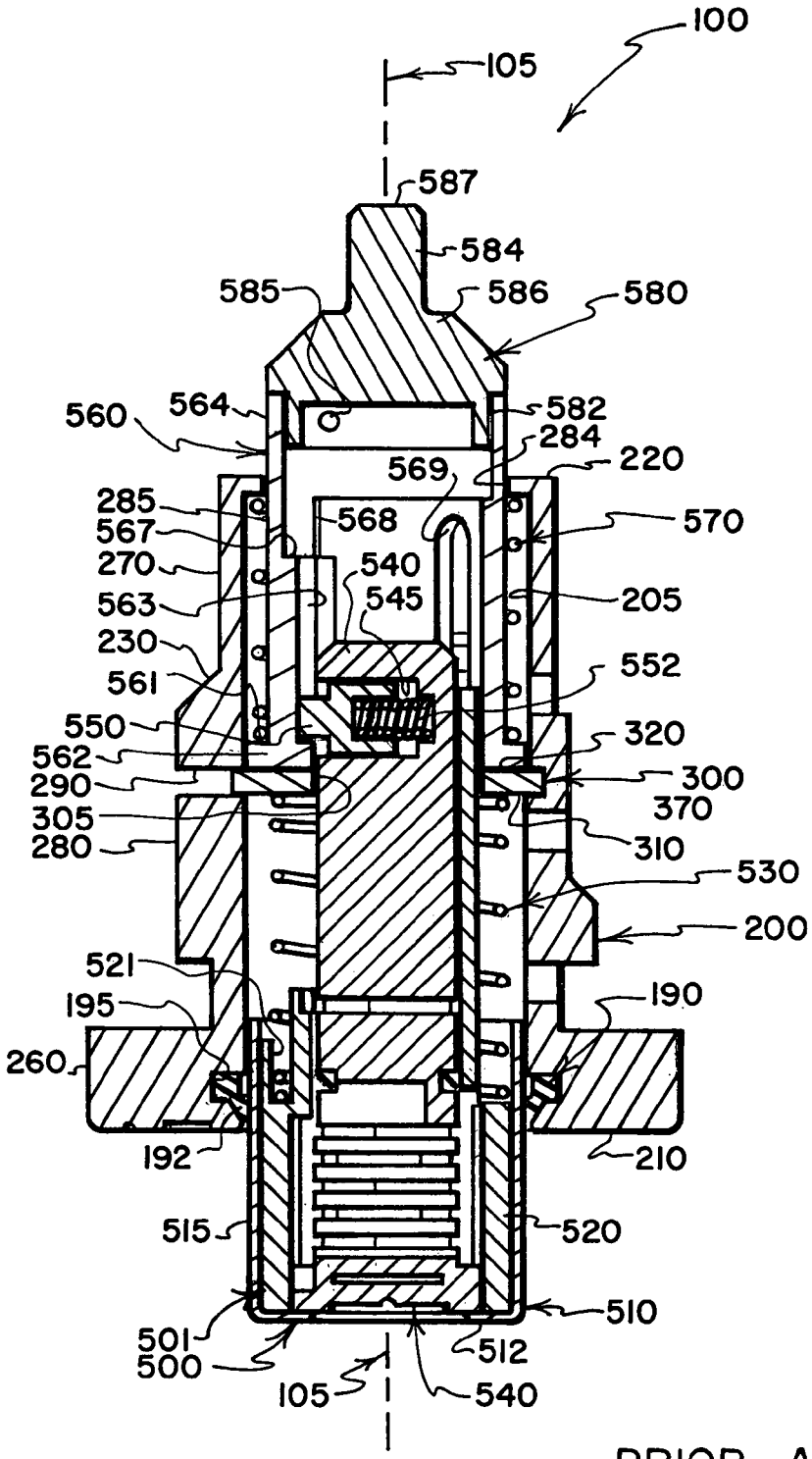
FIG. 9 PRIOR ART
FIG. 9 is a sectional view as seen from a plane indicated by a line 9-9 in FIG. 7.
Figure 10:
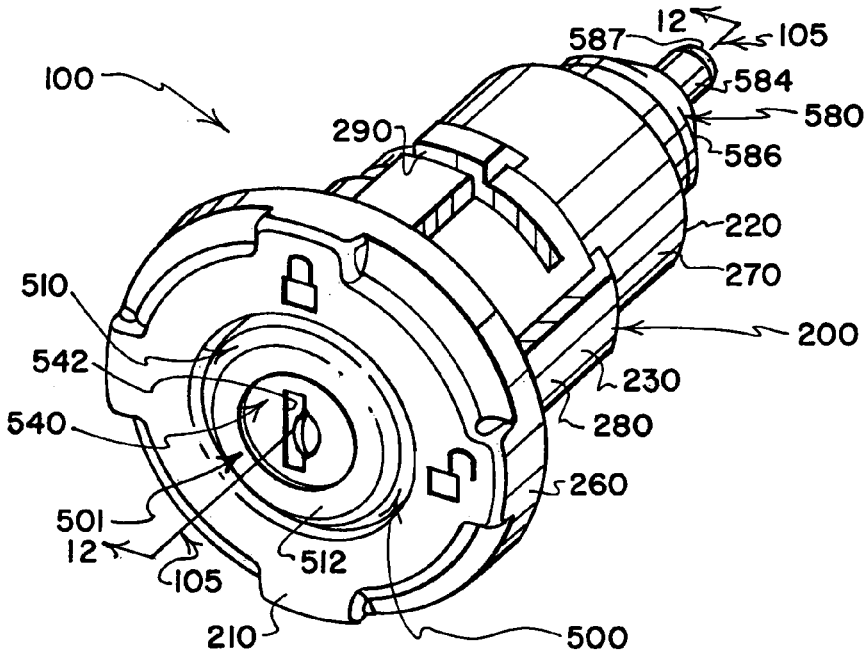
PRIOR ART FIG. 10
FIG. 10 is a perspective view similar to FIG. 7 but with the locked the push button depressed, it being seen that depression of the locked push button causes no corresponding rearward movement of the rear plunger type operating element which remains in its normal, non-extended, non-operated position.
Figure 11:
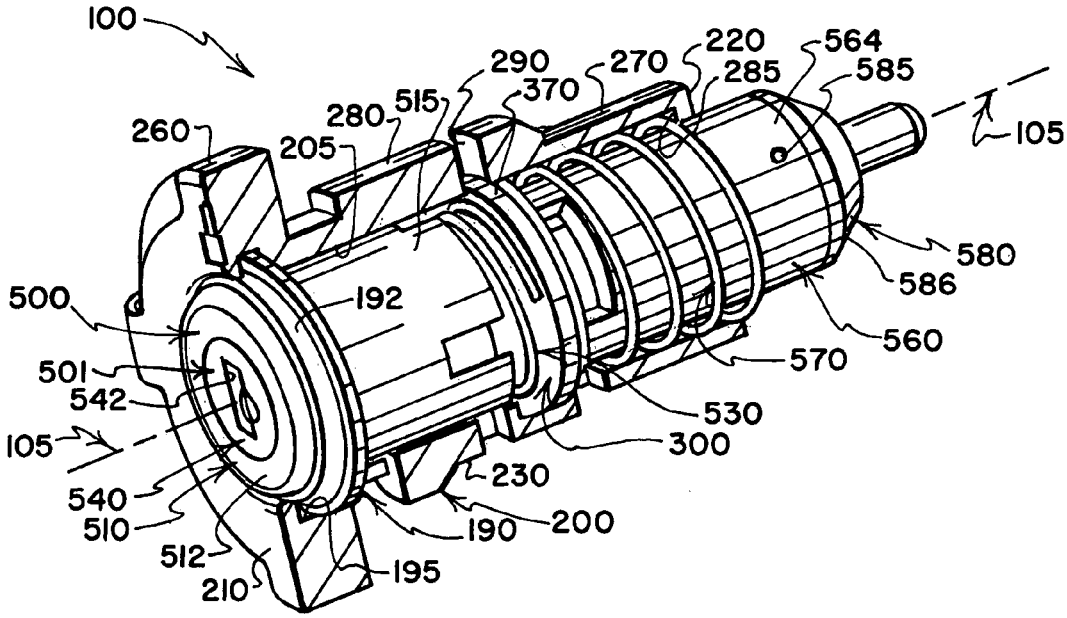
PRIOR ART FIG. 11
FIG. 11 is a perspective view thereof with portions broken away and shown in cross-section.
Figure 12:
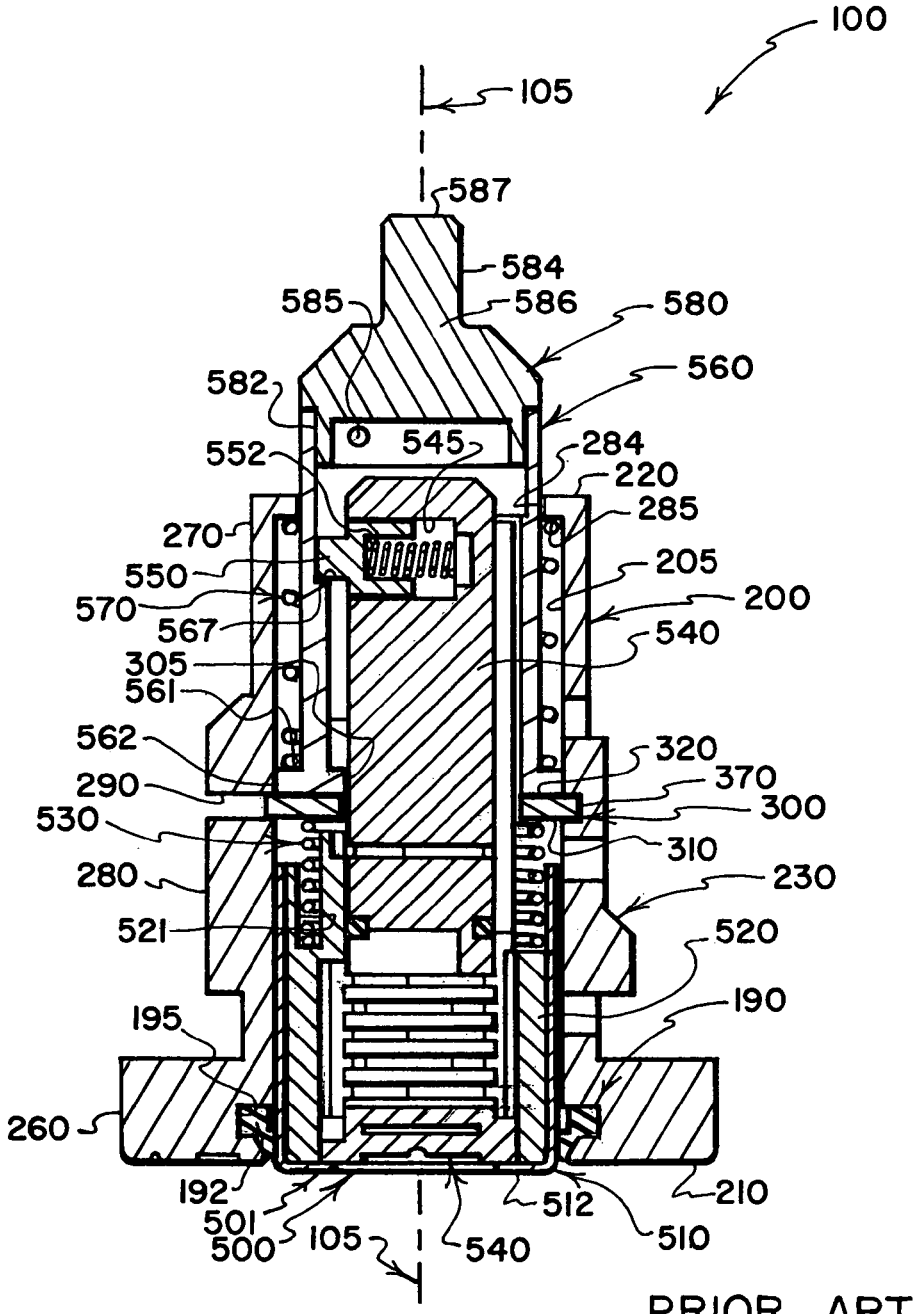
FIG. 12 PRIOR ART
FIG. 12 is a sectional view as seen from a plane indicated by a line 12-12 in FIG. 10.

When the plug 540 is turned to put the keyway 542 in a locked orientation depicted in FIGS. 7-12, the spring-projected bolt 550 carried by the plug 540 is oriented as depicted in FIG. 9 (where front portions of the push button assembly 500 are in their normal, extended, non-depressed positions) or as is depicted in FIG. 12 (where front portions of the push button assembly 500 are shown depressed). When in the position depicted in FIG. 12, the spring-projected bolt 550 extends behind a rearwardly facing shoulder 567 (see FIGS. 9, 12) of the primary rear element to prevent forward movement of the primary front element 520 (because the plug 540 and the primary front element 520 are connected by the retaining tumbler 546 of the plug 540, the front element 520 cannot move axially relative to the plug 540, therefore, when the bolt 550 latches the plug 540 so it cannot move forwardly, this latching of the plug 540 keeps the primary front element 520 from moving forward too). However, when the plug 540 is turned from the position of FIG. 12 to an unlocked position, a short, curved, ramp-like formation 568 (see FIG. 9) on the interior of the primary rear element 560 cams the bolt 550 inwardly just enough so it no longer extends behind the shoulder 567, which lets the bolt 550 move forwardly along the passage 563 (see FIG. 9) as the primary front element 520 also moves forwardly to the normal position depicted in FIG. 3.

When the plug 540 is turned to the locked orientation as depicted in FIGS. 7-12, front elements of the push button assembly 500 may remain in the normal, non-depressed, non-operated position shown in FIGS. 7-9, or may be depressed rearwardly to the position shown in FIGS. 10-12. However, rearward movement of the primary front element 520 while components are in the locked position depicted in FIGS. 7-9 will not cause rearward movement of the primary rear element 560 (nor will it cause rearward movement of the rear plunger element 580 which is pinned to the rear element 560) because, in the unlocked position of FIGS. 7-9, the bolt 550 does not drivingly connect the front and rear elements 520, 560 for concurrent axial movement. If the front elements are depressed from the non-operated position while the keyway 542 is in the locked orientation of FIGS. 7-9, the front elements then will be retained in the depressed position depicted in FIGS. 10-12 (due to the bolt 550 extending behind the shoulder 567 as described just above) unless and until a suitably configured key is inserted into and turned a quarter turn in the keyway 542 to reposition the keyway 542 to its unlocked orientation (which permits the bolt 550 to move forwardly as described just above).

The disc-shaped member 300 is used to regulate (i.e., to limit, restrict, inhibit, resist or otherwise control) movement of selected elements of the push button assembly 500 depicted in FIG. 21. One way in which the disc-shaped member 300 may serve a regulating function of this sort is to utilize one or both of the opposed side surfaces 310, 320 of the disc-shaped member 300 as "stops" or "stop surfaces" that can be engaged by elements of the push button assembly 500 to limit element translation along the axis 105, as has been described above.

Another way in which the disc-shaped member 300 may serve a regulating function calls for the housing 200 to be provided with one or more detent members that are biased toward engaging the disc-shaped member 300, such as the ball-shaped detent member 380 depicted in FIG. 13 (and in FIGS. 19 and 21 of the EPBA Patents) which is pressed by a resilient member 390 toward the disc-shaped member 300 so a portion of the ball-shaped detent member 380 can be received in a recess 360 formed in the circumferentially extending surface 370 of the disc-shaped member 300 to detent (i.e., to inhibit) the disc-shaped member 300 from turning about the central axis 105 relative to the housing 200. Because the primary front element 520 and the primary rear element 560 of the push button assembly 500 are coupled to the disc-shaped member 300 by a splined type connection (features of which have been described above), the detenting action of the detent member 380 on the disc-shaped member 300 also serves to inhibit turning about the central axis 105 others of the elements of the push button assembly 500, for example the front and rear primary elements 520, 560.

Referring to FIG. 14, a open tubular rear end region 563 of the primary rear element 560 receives a reduced diameter front end region 582 of the rear operating element 580 of the push button actuator unit 100 in a snug fit. A roll pin 585 as shown in FIG. 14, or a pair of shorter pins 585 as shown in FIG. 13, extend into aligned holes of the tubular rear end region 563 of the primary rear element 560 and of the reduced diameter front end region 582 of the rear operating element 580 to rigidly connect the elements 560, 580 for concurrent movement along the axis 105. Because the primary rear element 560 is prevented by interaction with other components of the actuator unit 100 from turning about the axis 105, the rear operating element 580 of the actuator unit 100 is prevented from turning about the axis 105 due to the rigid connection of the elements 560, 580 by the pin(s) 585.

Operation of the Prior Art Actuator Unit 100

Figure 1:
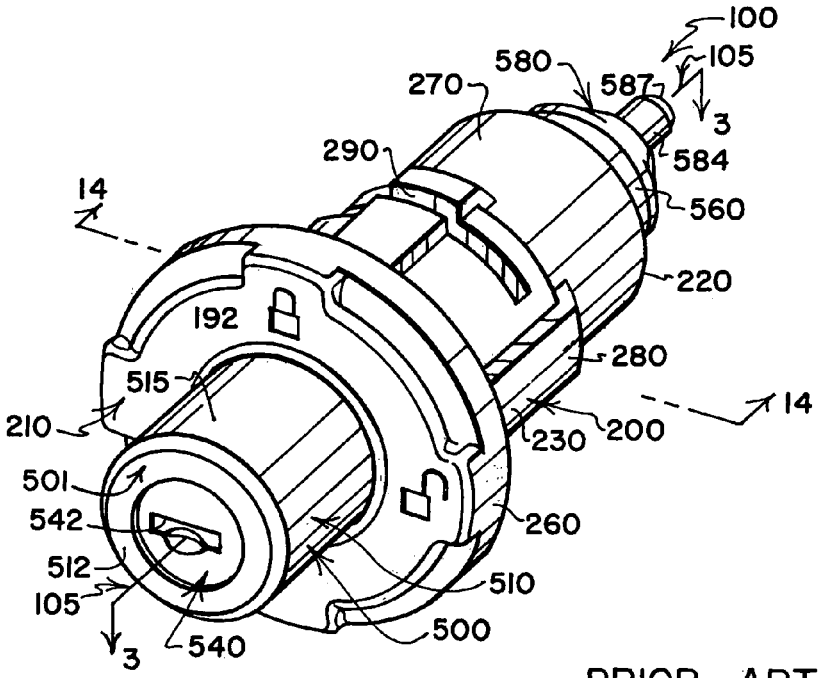
FIG. 1 PRIOR ART
FIG. 1 is a perspective view showing a prior art push button actuator unit of the type disclosed in the above-referenced EPBA Patents, with a lockable, depressable push button thereof in a normal, non-operated position projecting forwardly from a central passage of the unit's housing, with a keyway of the push button turned to an unlocked orientation, and with a rear plunger type operating element of the push button withdrawn to its normal, non-extended, non-operated position.

Referring FIGS. 1, 4, 7 and 10, a padlock symbol with closed shackle is provided on the front surface 210 of the annular bezel 260 in a 12 o'clock orientation about the central axis 105 to designate a first or locked orientation toward which components of the assembly 500 can be turned about the central axis 105; and a shackle-open padlock symbol is provided on the front surface 210 at a 3-o'clock orientation to designate a second or unlocked orientation to which components of the assembly 500 can be turned. When the keyslot 542 is horizontal and oriented to point toward the shackle-open padlock symbol as depicted in FIGS. 1 and 4, the push button 501 is turned to the unlocked orientation, and the push button actuator unit 100 is unlocked; and, when the keyslot 542 is vertical and oriented to point toward the shackle-closed padlock symbol as shown in FIGS. 7 and 10, the push button 501 is turned to the locked orientation, and the push button actuator 100 is locked.

Figure 2:
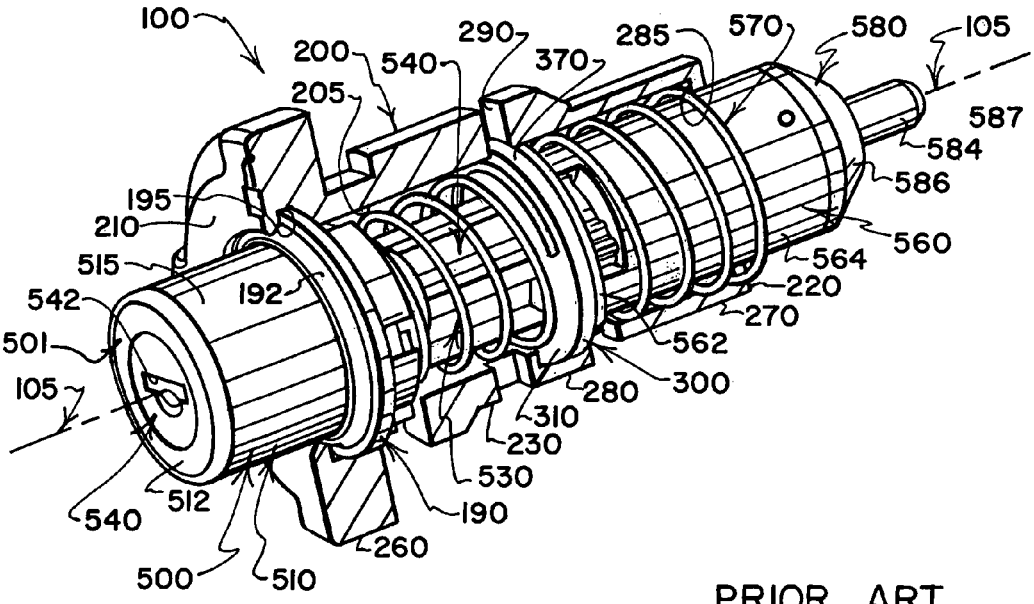
FIG. 2 PRIOR ART
FIG. 2 is a perspective view thereof with portions broken away and shown in cross-section.

Referring to FIG. 3, when components of the push button actuator unit 100 are unlocked (as depicted in FIGS. 1-3), an outer end region of the spring projected bolt 550 is biased to extend in front of a forwardly facing shoulder 566 (shown in FIG. 3 hereof, and in FIG. 22 of the EPBA Patents) of the primary rear element 560. When front components of the push button assembly 500 are depressed rearwardly along the axis 105 (at a time when components of the actuator unit 100 are in the unlocked orientation illustrated in FIGS. 1-3), the fact that the bolt 550 extends in front of the shoulder 566 of the primary rear element 560 causes the primary rear element 560 to move rearwardly when the push button 501 is moved rearwardly—which is to say that the rear operating element 580 of the unit 100 moves rearwardly in unison with the push button 501 when the push button 501 is depressed while turned to the unlocked orientation—as is shown in FIGS. 4-6.

Rearward movement of the plunger-type rear operating element 580 can be and preferably is utilized to engage and move (i.e., to operate) an auxiliary device (an example of which is indicated by the numeral 40 in FIGS. 17-19, 21, 22, 24, 26, 27 and 29-32) situated behind the push button actuator unit 100. However, because the push button actuator unit 100 has only one rear operating element 580, and because the single rear operating element 580 of the unit 100 does not turn and does not respond to any push button movement other than depression when turned to the unlocked orientation of FIGS. 1-6), the unit 100 is not well suited to engage, move and operate a plurality of auxiliary devices situated at locations near the rear of, or behind the push button actuator unit 100.

As is explained in detail in the referenced EPBA Patents, depression of the push button 501 is opposed by at least one of two springs 530, 570 carried within the passage 205 of the housing 200. If the push button 501 is depressed while turned to the unlocked orientation, the rear operating element 580 moves rearwardly in unison with the push button 501. If the push button 501 is depressed then released while turned to the unlocked orientation, both the push button and the rear operating element 580 will promptly return to their normal non-depressed, non-rearwardly-extended positions due to the action of the springs 530, 570.

If the push button 501 is depressed while turned to the locked orientation, the spring projected bolt 550 of the push button assembly 500 will cause the push button 501 to latch and be retained in its depressed position—but no rearward movement of the rear operating element 580 will occur as the result of the push button 501 being depressed while turned to the locked orientation. Thus, depression of the push button 501 is operative to cause rearward movement of the rear operating element 580 only when the push button is depressed while turned to the unlocked orientation. To release the push button 501 from being retained in a depressed position (after being depressed while turned to the locked orientation), a suitably configured key must be inserted into the keyway or key slot 542 and turned to the unlocked orientation, whereupon the push button 501 is immediately released and returns smartly to its normal, non-depressed position under the influence of the front spring 530.

How the characteristics of the push button actuator unit 100 (as described in the paragraphs above) are implemented by the components depicted in the drawings hereof is described in detail in the referenced EPBA Patents, to which the reader is referred if additional information regarding the prior art push button actuator unit 100 is desired.

Differences Between the Actuator Units 100, 1000

How the enhanced actuator unit 1000 differs from the original actuator unit 100 can most easily be grasped by comparing the components of the actuator 1000 that are illustrated in FIG. 15 with components of the actuator 100 that are illustrated in FIG. 14.

The original actuator unit 100 has only one rear operating element 580, whereas the enhanced actuator unit 1000 is provided with a pair of outer and inner rear operating elements 1580, 1575, respectively, that extend substantially concentrically along the center axis 1105 of the unit 1000. The outer operating element 1580 has a non-circular opening 1581 that extends along the axis 1105. The elongate inner operating element 1575 (which preferably is formed as an extension of the plug 1540, front portions of which preferably have the same configuration as the plug 540 of the unit 100) has a uniform non-circular cross-section that is received in a slip fit in the non-circular opening 1581 provided at the rear of the outer rear operating element 1580.

As depicted in FIG. 15, the cross-sections of the elongate inner rear operating element 1575 and the axially extending opening 1581 of the outer rear operating element 1580 function like a splined driving connection that causes the inner and outer operating elements 1575, 1580 to turn in unison about the center axis 1105 of the unit 1000. By this arrangement, the outer rear operating element 1580 (which otherwise has no reason to turn about the axis 1105) is caused to turn about the axis 1105 in unison with the push button 1501 of the unit 1000 because the plug 1540 is a component of the push button 1501—and because the plug 1540 defines at least a portion of the keyslot 1542 into which a key is inserted and turned to cause the push button 1501 to turn between the locked and unlocked orientations.

Figure 24:
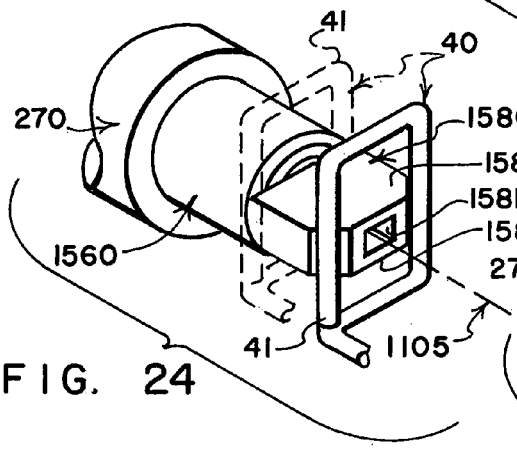
FIG. 24 is a perspective view similar to FIG. 19 showing a portion of the rear end region of the unlocked and operated actuator unit of FIGS. 20-23 with the rectangular loop of the actuator rod shown by solid lines in its rearwardly moved operated position and by broken lines in its non-operated position.
Figure 27:
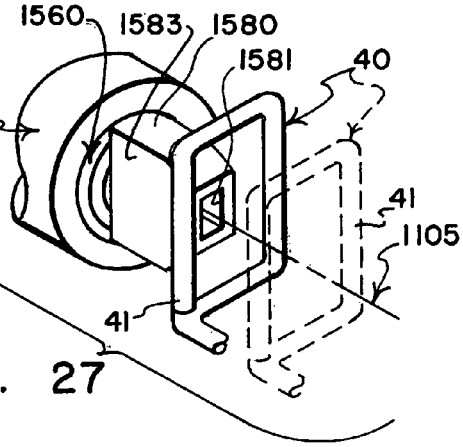
FIG. 27 is a perspective view similar to FIGS. 19 and 24 showing a portion of the rear end region of the locked and non-operated actuator unit of FIGS. 25 and 26 with the rectangular loop of the actuator rod shown by solid lines in non-operated position and by broken lines in its operated position.
Figure 25:
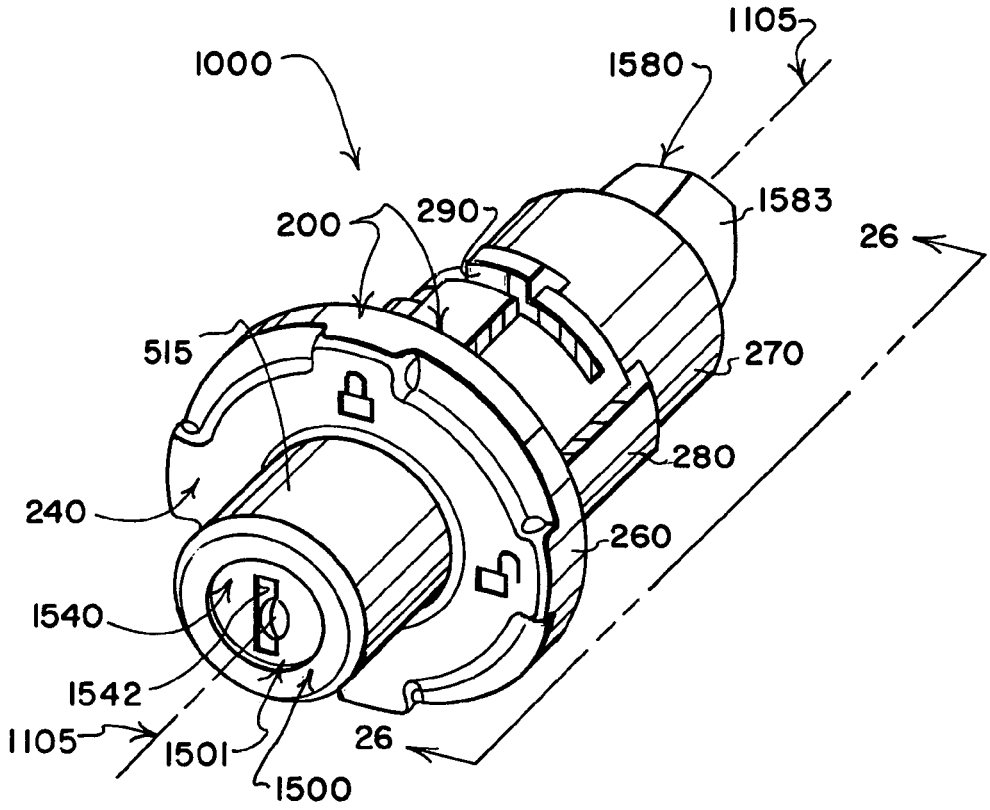
FIG. 25 is a perspective view similar to FIGS. 16 and 20 of the push button actuator unit with the keyway of the front push button turned to a twelve o-clock locked orientation, with the depressable forwardly biased front push button of the unit in the same forwardly extended and non-operated position shown in FIG. 16, with the outer rear operating element of the unit turned to the twelve o'clock locked orientation as the result of the keyway of the front push button also being turned to the twelve o'clock locked orientation, and with all elements of the rear plunger portion of the push button actuator unit withdrawn to their normal, non-depressed non-rearwardly-extended positions.
Figure 26:
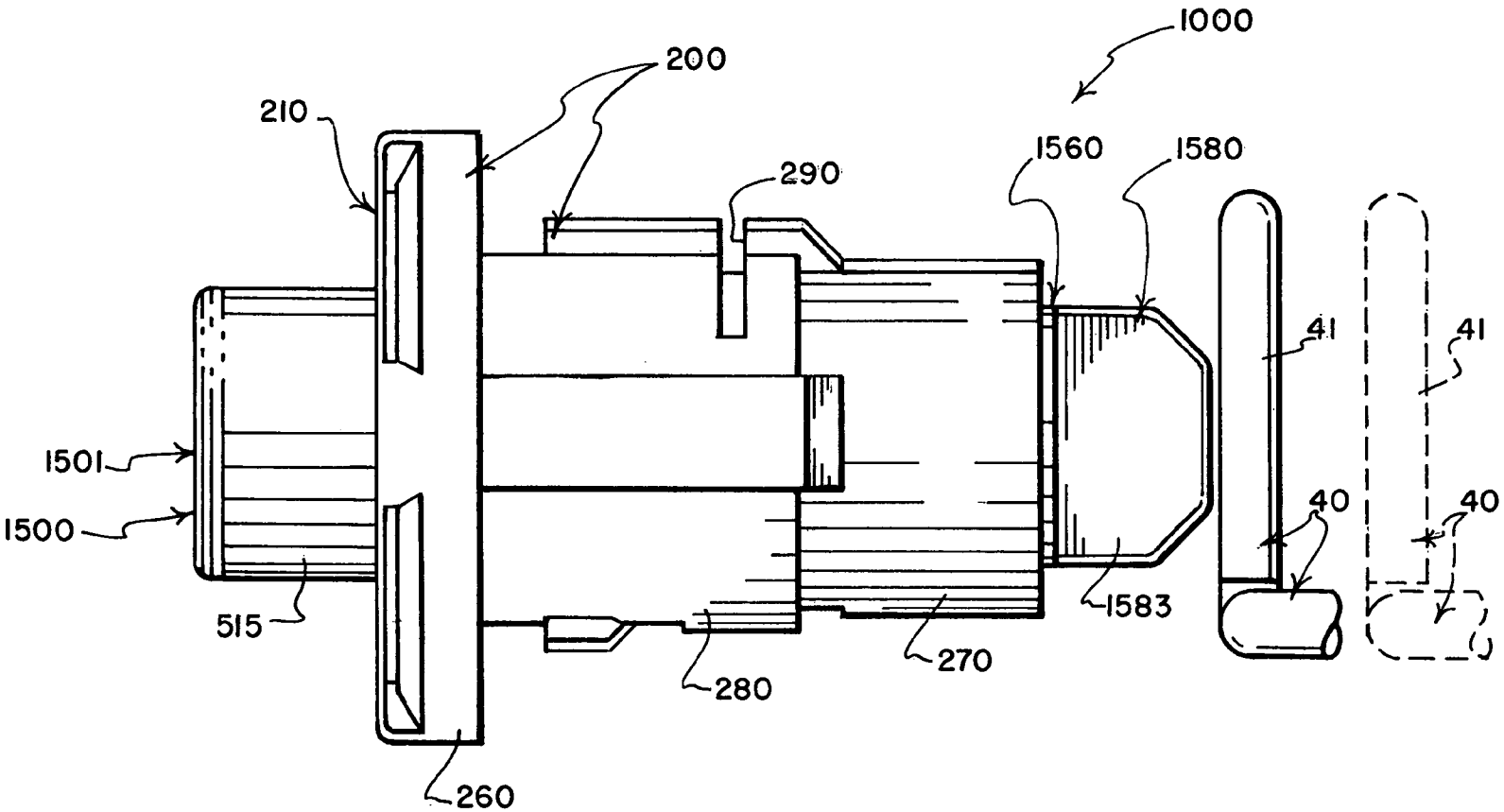
FIG. 26 is a right side elevational view of the unit of FIG. 25 with components thereof in the same positions as in FIG. 25, and showing the rectangular loop of the actuator rod depicted by solid lines in the non-operated position where it is not engaged by any part of the push button actuator unit, and with the operated position of the actuator rod loop depicted by broken lines.
Figure 28:
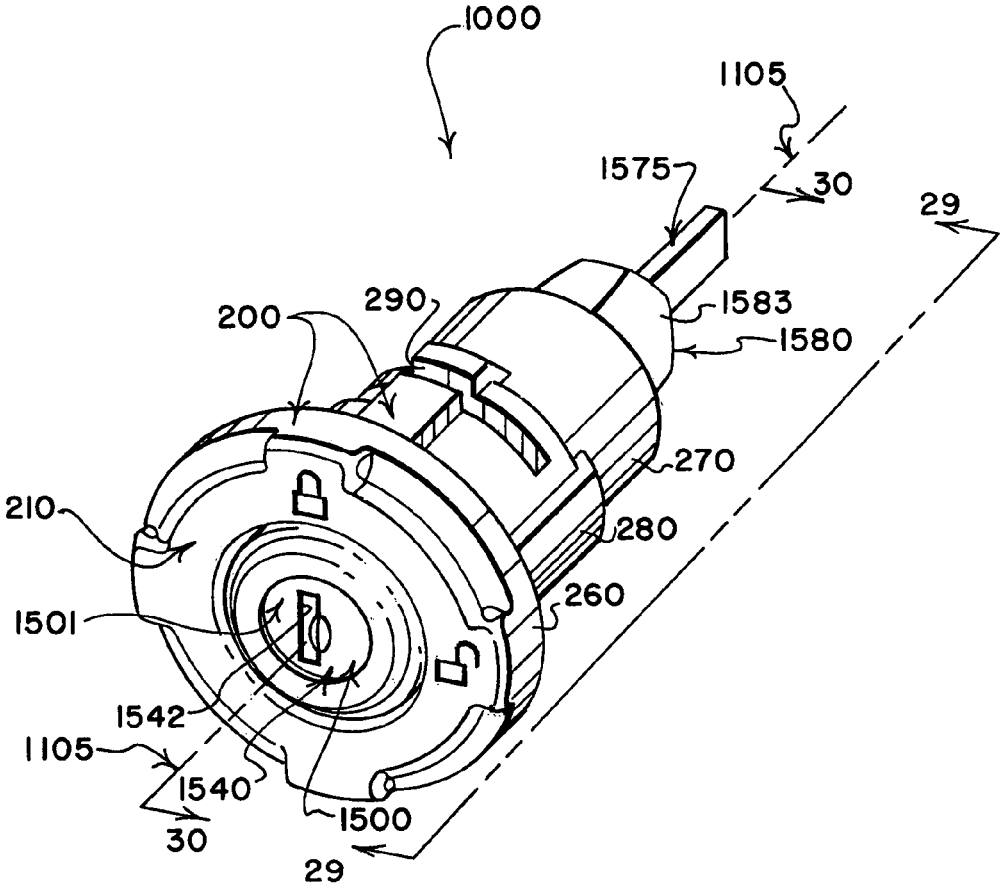
FIG. 28 is a perspective view similar to FIGS. 16, 20 and 25 of the push button actuator unit with the keyway of the front push button turned to the twelve o'clock locked orientation, with the depressable forwardly biased front push button of the unit in the depressed position (where it is automatically retained each time the front push button is moved rearwardly to the depressed position after the keyway thereof is turned to the locked orientation), with the outer rear operating element turned to the twelve o'clock locked orientation in response to the front push button being turned thereto.
Figure 29:
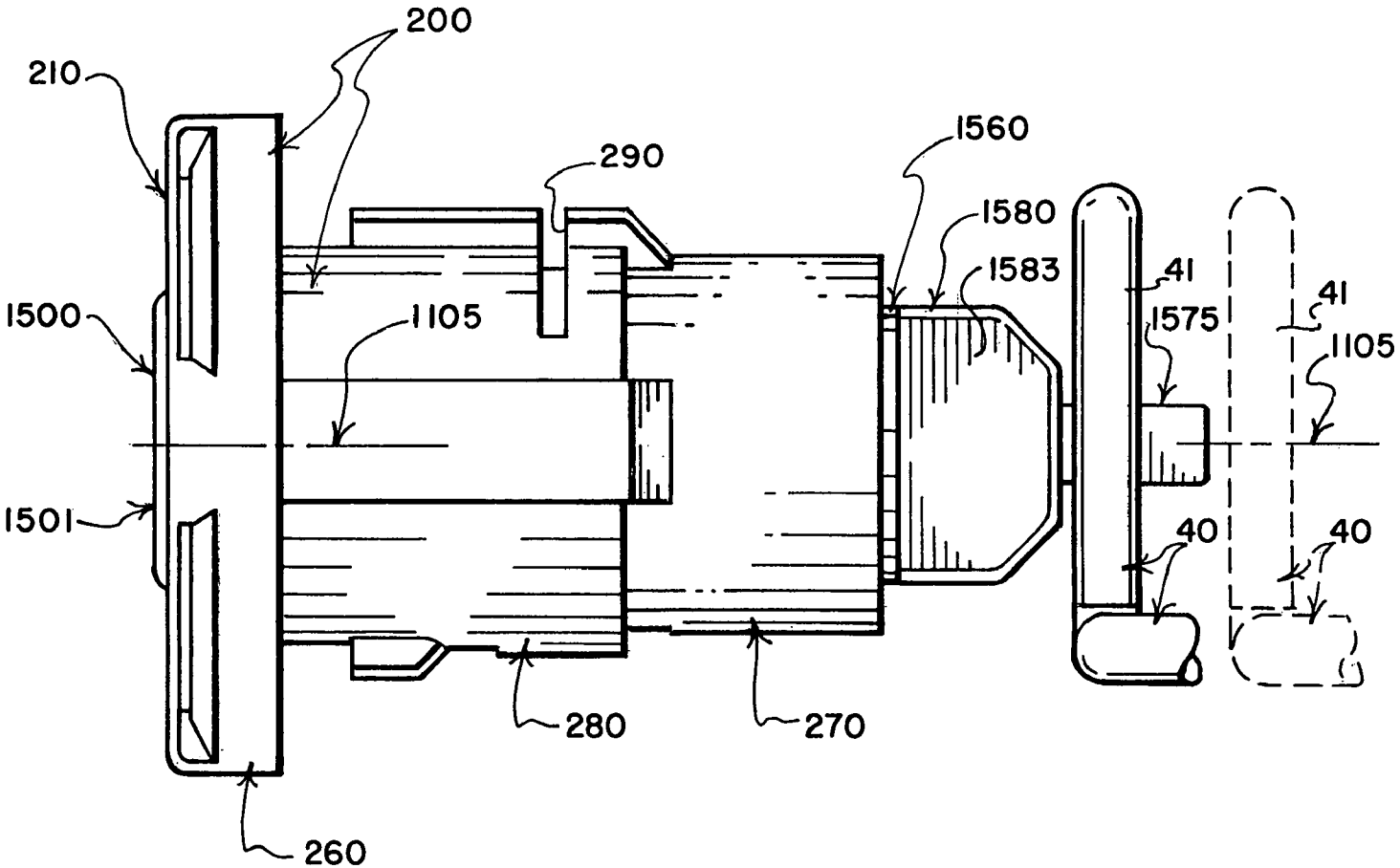
FIG. 29 is a right side elevational view of the unit of FIG. 28 with components thereof in the same positions as in FIG. 28, and showing the rectangular loop of the actuator rod depicted by solid lines in the non-operated position where it is not engaged by any part of the push button actuator unit even though the inner rear operating element extends through the rectangular loop of the actuator rod, and with the operated position of the actuator rod loop depicted by broken lines.
Figure 30:
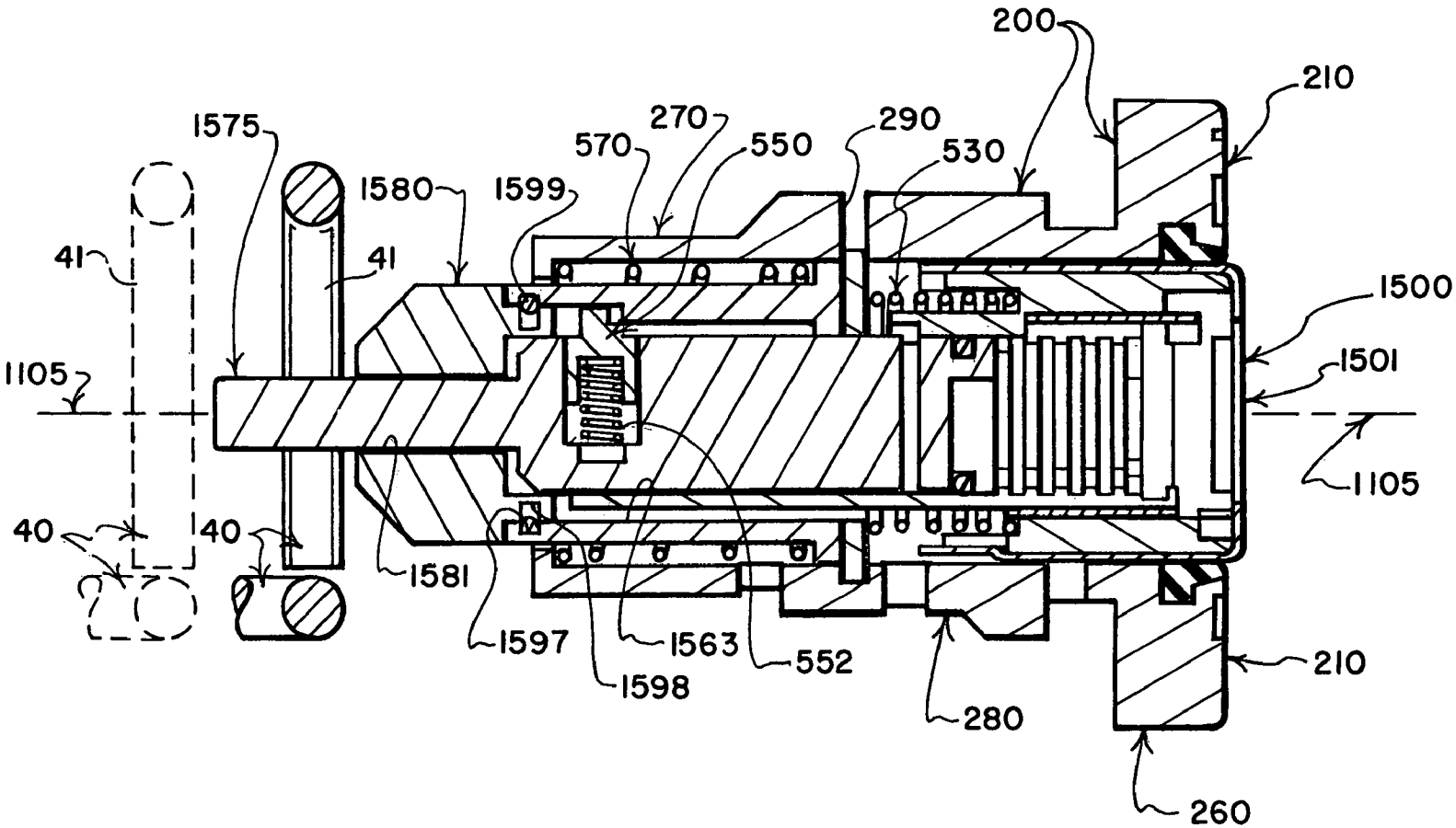
FIG. 30 is a cross-sectional view of the locked actuator unit of FIGS. 28 and 29 as seen from a plane indicated by a line 29-29 in FIG. 28, with the depicted components of the unit in the same positions illustrated in FIGS. 28 and 29.

In addition to being relatively movable, the rear operating elements 1575, 1580 of the enhanced actuator unit 1000 are movable in different ways in response to depression of the push button 1501 when the push button 1501 is turned to different orientations about the axis 1105. When the push button 1501 is turned to the locked orientation as depicted in FIGS. 25 and 26 and then is depressed as depicted in FIGS. 29-30, the inner rear operating element 1575 is caused to extend rearwardly beyond the outer rear operating element 1580 in the manner illustrated in FIGS. 29-31. When the push button 1501 is turned to the unlocked orientation as depicted in FIGS. 16-18 and then is depressed as depicted in FIGS. 21-23, the outer rear operating element 1580 is caused to extend rearwardly beyond the inner rear operating element 1575 in the manner shown in FIGS. 22-24.

Figure 16:
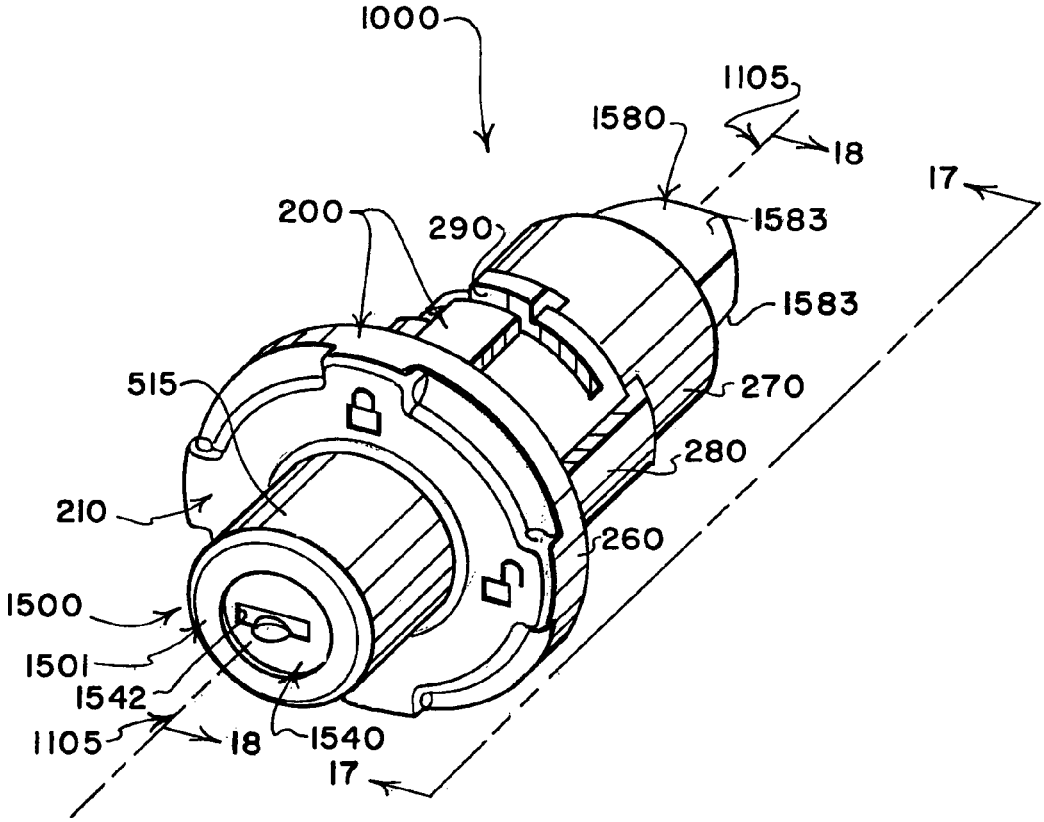
FIG. 16 is a perspective view similar to FIG. 1 showing an enhanced form of push button actuator unit that embodies features of the present invention and that utilizes the components depicted in FIG. 15, with the keyway of the forwardly biased front push button turned to a three o'clock unlocked orientation, with the push button in its forwardly extended and non-operated position, with all elements of a rear plunger portion of the push button actuator unit withdrawn to their normal, non-operated positions, and with an outer rear operating element of the unit turned to the three o-clock unlocked orientation as the result of the keyway of the push button also being turned to the three o'clock unlocked orientation.
Figure 17:
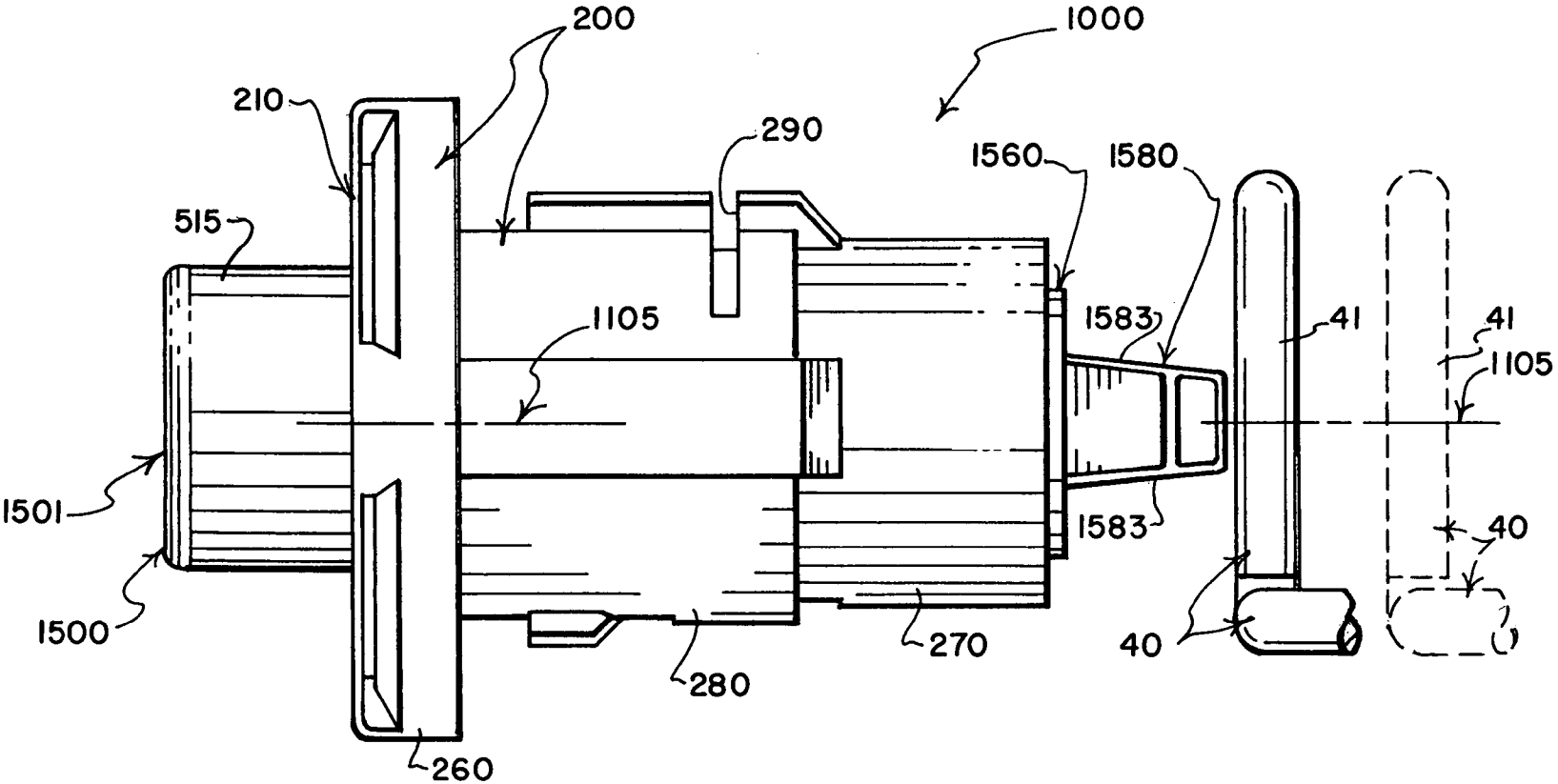
FIG. 17 is a right side elevational view of the unit of FIG. 16 with components thereof in the same positions as in FIG. 16, and showing a rectangular loop of an actuator rod situated behind the push button actuator unit, with solid lines showing the actuator rod loop in its forward, non-operated position disengaged by the actuator unit, and with broken lines showing the actuator rod loop moved to its rearward operated position.
Figure 18:
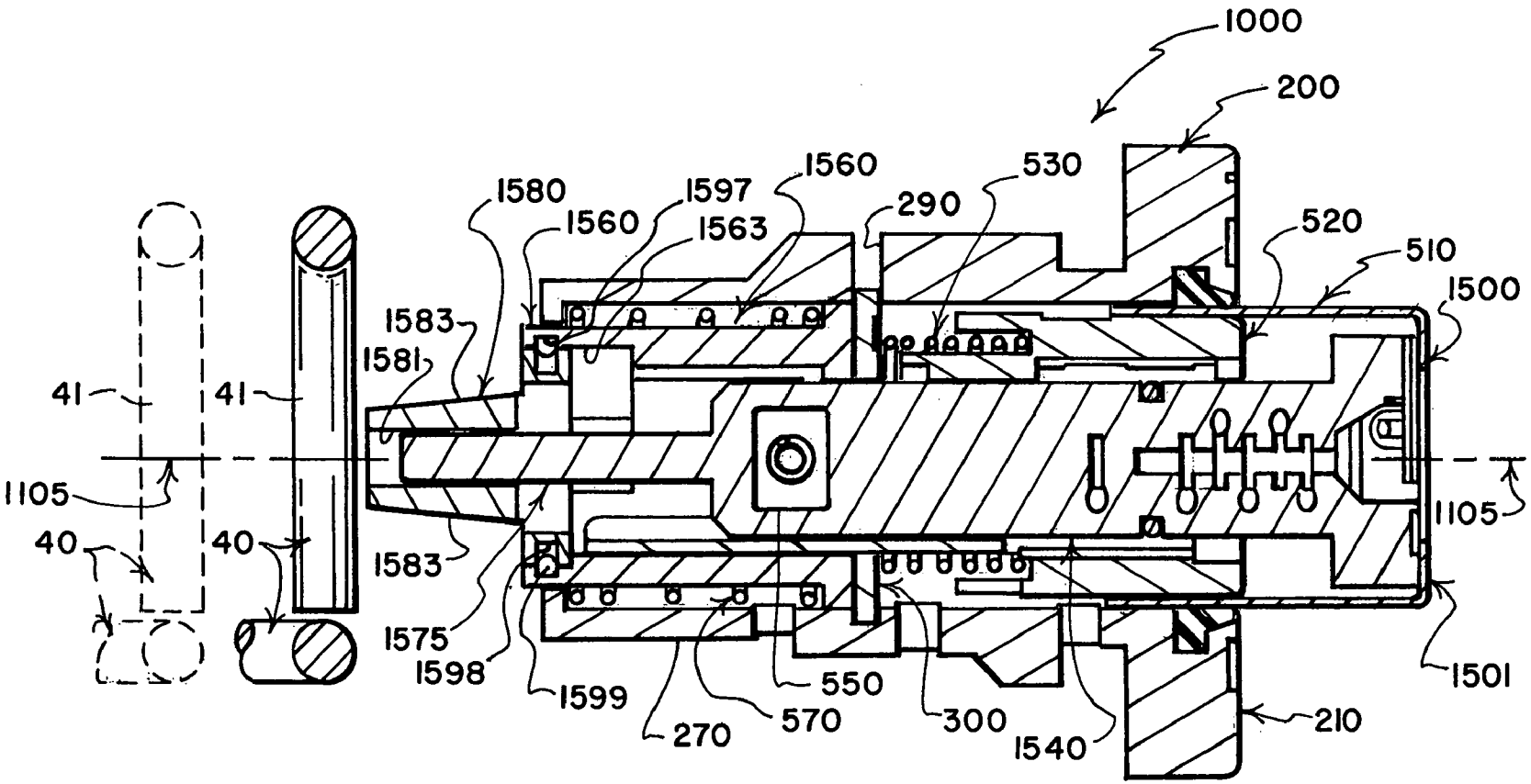
FIG. 18 is a cross-sectional view of the unlocked and non-operated actuator unit of FIGS. 16 and 17 as seen from a plane indicated by a line 18-18 in FIG. 16, and with the rectangular loop of the actuator rod also shown in cross-section and depicted by solid lines in its non-operated position, and by broken lines in its rearwardly moved operated position.
Figure 22:
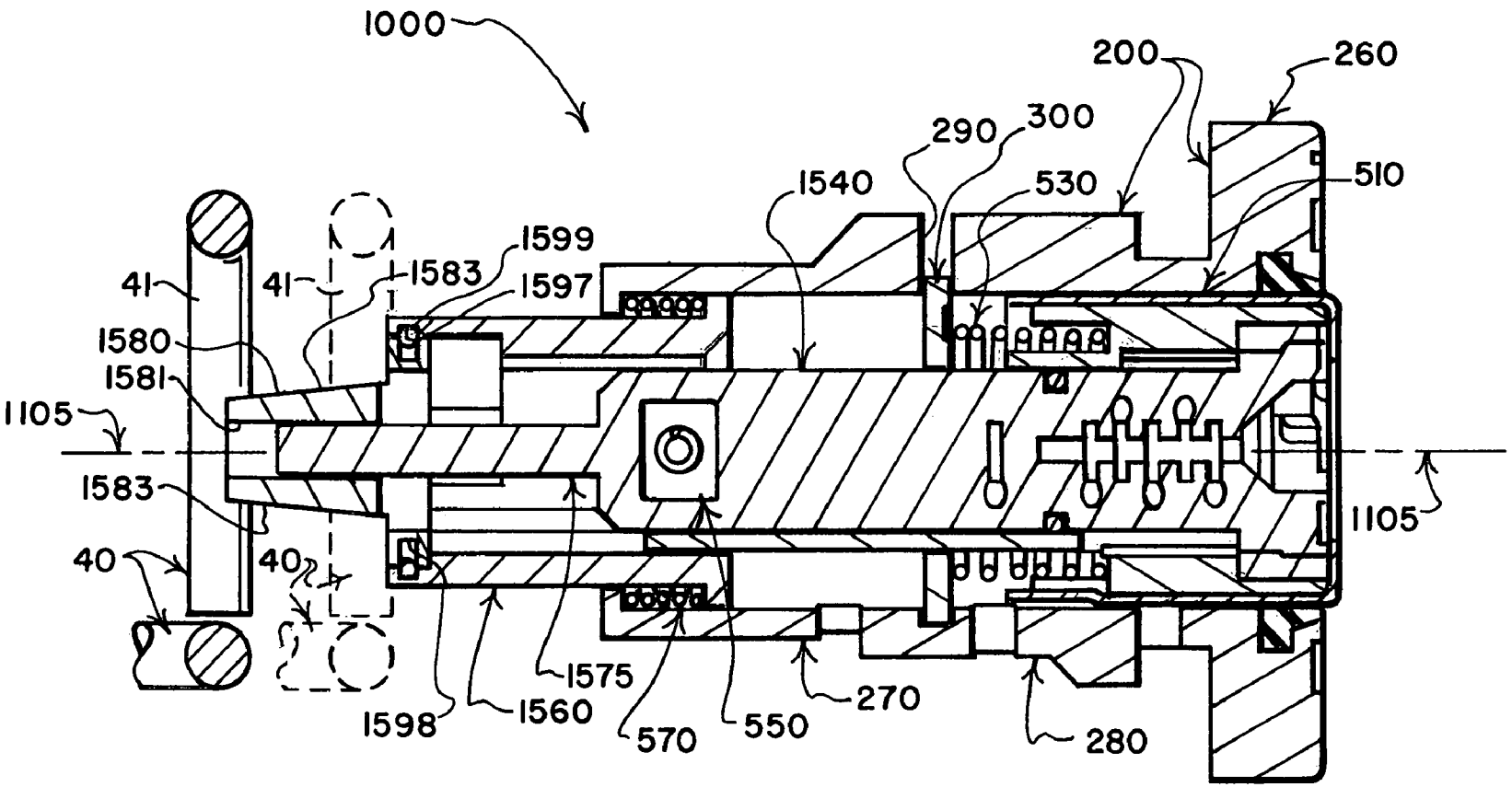
FIG. 22 is a cross-sectional view of the unlocked and operated actuator unit of FIGS. 20 and 21 as seen from a plane indicated by a line 22-22 in FIG. 20 with the rectangular loop of the actuator rod also shown in cross-section and depicted by solid lines in its operated position, and by broken lines in its non-operated position.
Figure 23:
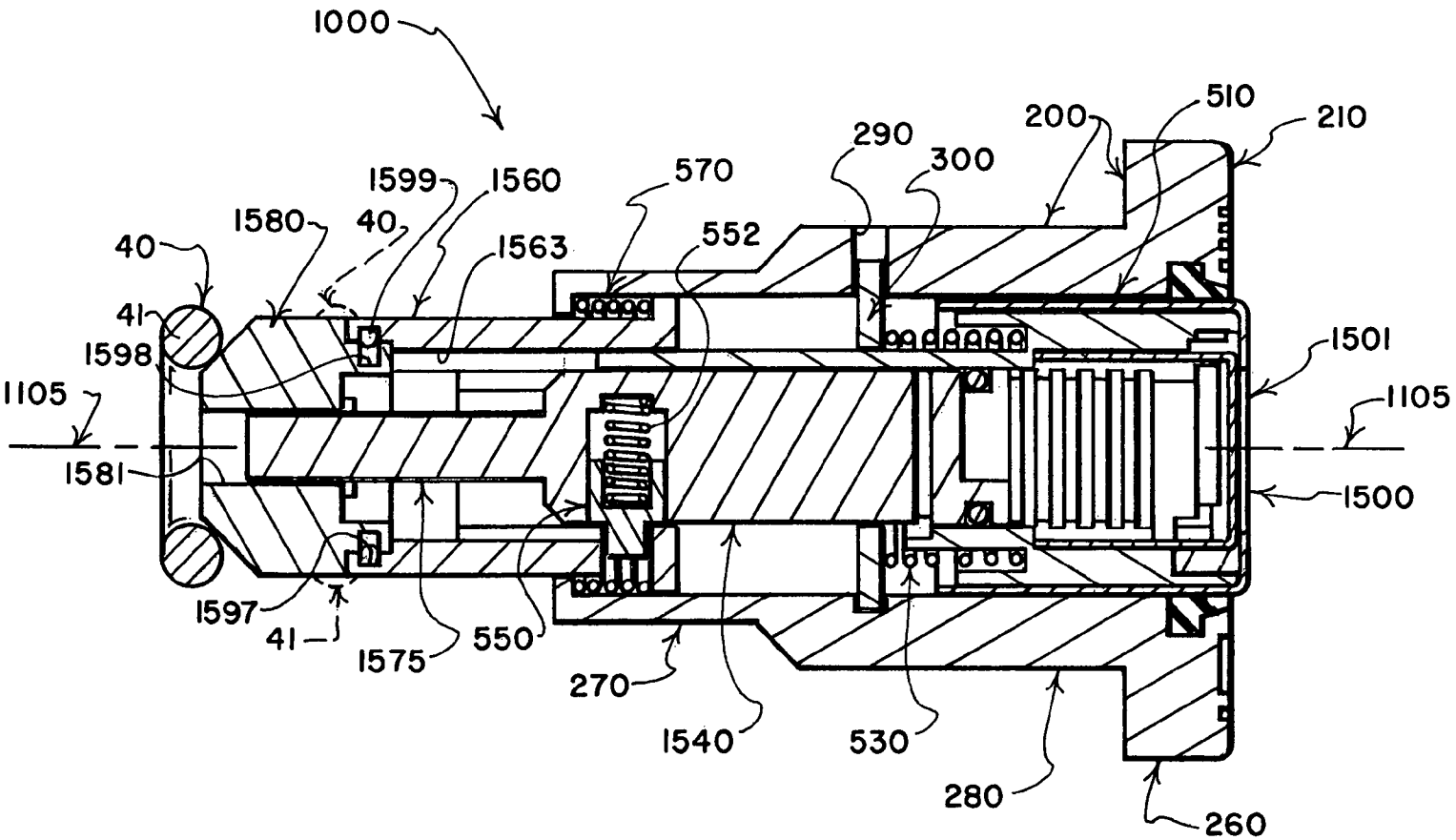
FIG. 23 is a cross-sectional view as seen from a plane indicated by a line 23-23 in FIG. 20.

When the push button 1501 is moved rearwardly to the depressed position shown in FIGS. 21-23 while turned to the unlocked orientation of FIGS. 16-18, and then is released, the push button 1501 and the inner rear operating element 1575 (which is an integral part of the plug 1540 and of the push button 1501) promptly return to the non-depressed positions depicted in FIGS. 16-18. This is due to the fact that, when depressed while unlocked, the push button 1501 is not latched or retained in the depressed position by the unit 1000—which means that the extension of the outer rear operating element 1580 can be used to effect momentary operation of an auxiliary device located behind the unit 1000 (such as the actuator of an electrical switch, not shown).

However, when the push button 1501 is moved rearwardly to the depressed position while turned to the locked orientation, the resulting rearward movement of the inner rear operating element 1575 (shown in FIGS. 28-31 and depicted schematically in FIG. 36) can be used to rearwardly move and thereby operate an auxiliary device such as the actuator 90 (FIG. 36) of an electrical switch, and this operation will be of a "maintained" character inasmuch as the push button 1501 and the inner rear operating element 1575 are latched in their rearwardly moved and operated positions when the locked push button 1501 is depressed.

In the original actuator unit 100, a single roll pin 585 such as is depicted in FIG. 14 (or shorter dual pins 585 such as are shown in FIG. 13) are used to rigidly connect the elements 560, 580—so the single rear operating element 580 of the actuator unit 100 does not normally turn, and can move rearwardly only when the push button 501 is depressed while unlocked. In contradistinction, the outer rear operating element 1580 of the enhanced actuator unit 1000 is turnably connected to the primary rear element 1560 of the actuator 1000 by a split, C-shaped circular ring 1599 formed from a length of spring steel wire (FIG. 15) that is installed in a pair of aligned grooves 1597, 1598 (FIGS. 18, 22, 23 and 30) formed in the tubular interior 1563 of the primary rear element 1560 and in the exterior diameter of the forwardly extending part 1582 of the outer rear operating element 1580. Accordingly, a significant difference between the actuator units 1000 and 100 is that the outer rear operating element 1580 of the actuator unit 1000 can turn about the central axis 1105, whereas the corresponding single rear operating element 580 of the actuator unit 100 is not intended to turn about the central axis 105.

Figure 31:
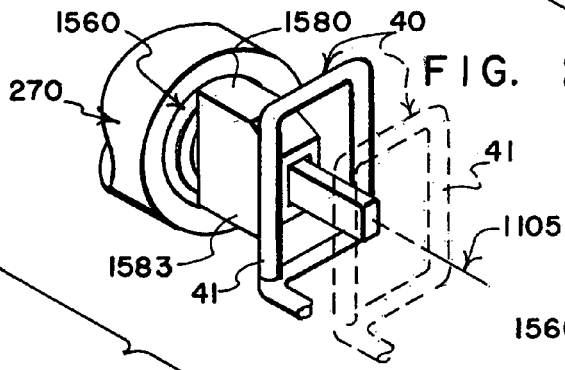
FIG. 31 is a perspective view similar to FIGS. 19, 24 and 27 showing a portion of the rear end region of the locked and button-depressed actuator of FIGS. 28-30 with the rectangular loop of the operating rod shown by solid lines in non-operated position and by broken lines in its operated position.
Figure 32:
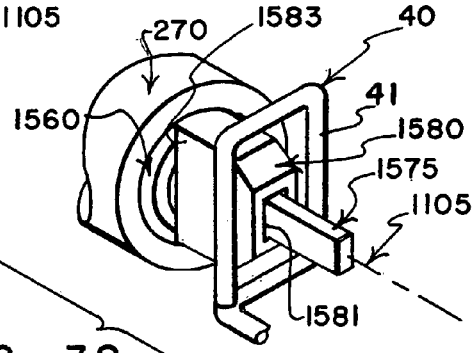
FIG. 32 is a perspective view similar to FIGS. 19, 24, 27 and 31 showing a portion of the rear end region of the locked and button-depressed actuator of FIG. 31 in a rearwardly moved position illustrating how, even when the depicted portion of the push button actuator unit is moved closer to the loop of the actuator rod (for example as by hammering the front of the unit and/or structure, not shown, that supports the unit), the rectangular configuration of the actuator rod merely extends loosely about and is not depressed by any of the rear operating elements of the unit.
Figure 20:
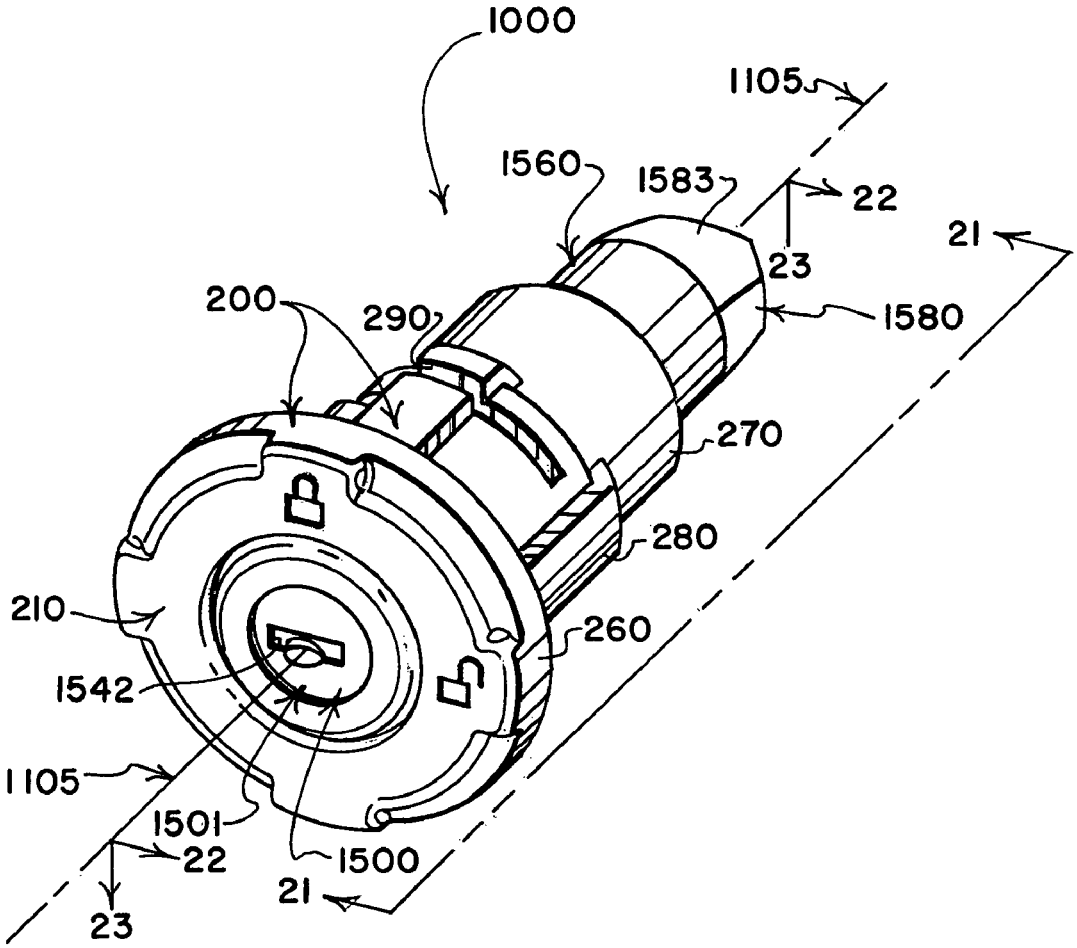
FIG. 20 is a perspective view similar to FIG. 16 of the push button actuator unit with the keyway of the front push button still turned to the three o'clock unlocked orientation, with the depressable forwardly biased front push button of the unit moved rearwardly to a depressed and operated position, and with the outer rear operating element of the rear plunger portion of the push button actuator unit still turned to the three o'clock unlocked orientation.

The appearance offered by the frusto-conically joined dual-diameter regions of the single rear operating element 580 of the actuator unit 100 is quite different than the appearance of the outer rear operating element 1580 of the actuator unit 1000 which includes opposed flat side surfaces 1583 that extend in parallel relationship at equally spaced distances from the central axis 1105—which gives the maximum exterior cross-section of the outer rear operating element 1580 a generally rectangular shape that can pass freely through the rectangular loop 41 of the actuator rod 40 in a manner depicted in FIG. 32 wherein the actuator unit 1000 (or a panel, not shown, on which the actuator unit 1000 is mounted) has been pounded rearwardly in an attempt to cause the actuator unit 1000 to operate the actuator rod 40 while the push button 1501 is latched in its depressed position while turned to the locked orientation. The normal appearance of the rear end region of the unit 1000 when the push button 1501 is depressed while locked as depicted in FIG. 31 is seen to differ from the rearwardly moved position shown in FIG. 32. How the outer rear actuator member 1580 operates the actuator rod 40 by engaging the two most closely spaced sides of the loop 41 when the push button 1501 is depressed when turned to the unlocked orientation is illustrated in FIG. 24, and in FIGS. 21-23 which utilizes solid lines to show the actuator rod 40 when operated, and broken lines to show the actuator rod 40 when in its normal non-operated position.

The Enhanced Actuator Unit 1000

The enhanced push button actuator unit 1000 preferably utilizes the same housing 200 as is used by the original actuator unit 1000. Many other components of the units 100, 1000 are identical, as is confirmed by the use in FIGS. 15-32 of the same 3-digit reference numerals as are employed in the FIGS. 1-14 that relate to features of the original actuator unit 100.

Features of the enhanced actuator unit 1000 that differ from those of the original actuator unit 100 are explained in the paragraphs above, hence there remains little else about the enhanced actuator unit 1000 to describe.

The units 100, 1000 operate in substantially the same manner except that the movement of the plug 1540 is translated rearwardly through the outer rear operating element opening 1581 by the inner rear operating element 1575; and the outer rear operating element 1580 is permitted to turn (and, in fact, is keyed to the inner rear operating element 1575 to turn therewith by the slip fit connection established by the inner rear operating element 1575 extending through the opening 1581 of the outer rear operating element 1580), whereas the single rear operating element 580 of the unit 100 is not intended to turn.

Operation of the Enhanced Actuator Unit 1000

When components of the enhanced push button actuator unit 1000 are oriented as shown in FIGS. 16-18, the unit 1000 is unlocked, and the forwardly biased front push button 1501 of the unit 1000 is in its forwardly extended and non-operated position. If the generally rectangular loop 41 of the forwardly-rearwardly movable actuator rod 40 is stationed behind the unit 1000 as shown in FIG. 19, neither the outer rear operating element 1580 nor the inner rear operating element 1575 engage the loop 41, and the actuator rod 40 remains in the normal non-operated position depicted in FIG. 19.

When rearwardly movable components of the push button assembly 1500 of the enhanced unit 1000 are depressed after the push button 1501 has been turned to the unlocked orientation as is depicted in FIGS. 20-23, the outer rear operating element 1580 extends rearwardly beyond the inner rear operating element 1575 as is shown in FIG. 22. As the outer rear operating element 1580 moves rearwardly, it engages and rearwardly moves the actuator rod loop 41, which means that the actuator rod 40 is "operated" to cause some auxiliary device (not shown) such as a locking system of a tool box or the like to release.

If the push button 1501 is depressed after it has been turned to the locked orientation depicted in FIGS. 25-26, the outer rear operating element 1580 has no reason to move rearwardly from the non-operated position as shown in FIGS. 25-26. However, depression of the push button 1501 while turned to the locked orientation does cause the inner rear operating element 1575 to move rearwardly to the position shown in FIGS. 28-31 where the inner rear operating element 1575 extends rearwardly beyond the still unmoved outer rear operating element 1580 to project harmlessly through the rectangular loop 41 of the actuator rod 40, as is shown in FIG. 31 without causing the actuator rod 40 to be moved from its forward non-operated position.

Should the entire push button actuator unit 1000 be hammered rearwardly (by someone seeking to defeat the operation of the unit 1000 by force) to the rearward position illustrated in FIG. 32, the rectangular shape of the rectangular loop 41 of the actuator rod 40 still will not be caused to move rearwardly to operate a lock or other auxiliary device that may be connected to the rod 40, because the rectangular shape of the outer rear operating element 1580 is sized and configured to extend harmlessly through the loop 41 without touching or causing movement of the actuator rod 40.

Figure 33:
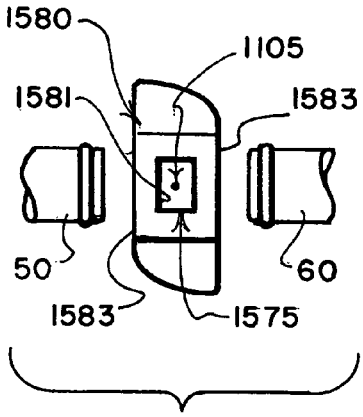
FIG. 33 is a schematic rear view of a portion of a modified form of push button actuator having its outer rear operating element extending between and not engaging nor operating a pair of actuators or auxiliary devices located on opposite sides of the axis about which the depicted outer operating element can turn.
Figure 34:
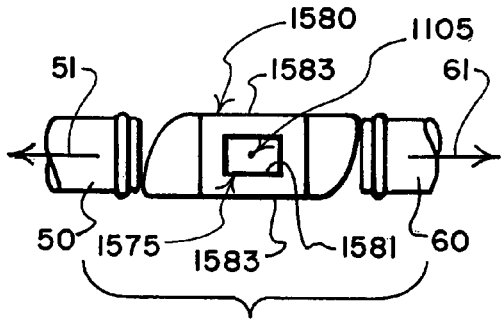
FIG. 34 is a schematic rear view similar to FIG. 33 but with the depicted outer rear operating element turned a quarter turn to a different orientation than is shown in FIG. 33 to engage and operate the depicted opposed actuators or auxiliary devices.

Referring to FIG. 33, if the generally rectangular shape of the previously described and illustrated outer rear operating element 1580 is modified to provide two opposed curved corner regions giving the element 1580 something of a propeller shape as is depicted schematically in FIGS. 33 and 34, the modified outer rear operating element 1580 can still reside between a pair of oppositely movable actuators 50, 60 without engaging, moving or operating the actuators 50, 60. When, however, the modified outer rear operating element 1580 is turned about the axis 1105 as depicted in FIG. 34 to engage and move the actuators 50, 60 leftwardly and rightwardly, respectively, as is indicated by arrows 51, 61, the turning movement alone of the outer rear operator member 1580 can be used to operate the actuators 50, 60.

Figure 35:
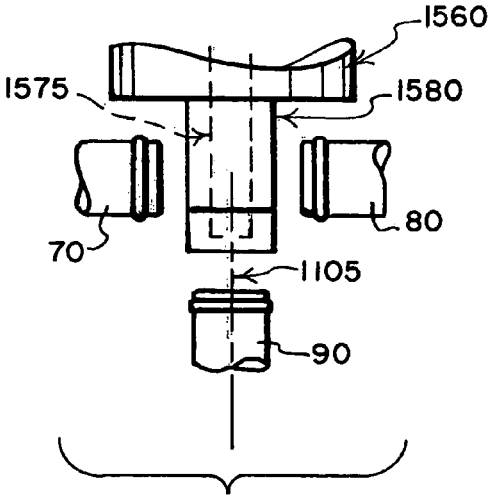
FIG. 35 is a schematic top view showing rear operating element portions of a push button actuator unit extending among but not engaging and not operating any of three depicted actuators which are located on opposite sides of and to the rear of the depicted operating element portions; and, FIG. 36 is a schematic top view similar to FIG. 35 with an inner rear operating element of the actuator unit extended (rearwardly along an axis about which the outer operating element can turn) to engage and rearwardly move the depicted actuator or auxiliary device.
Figure 36:
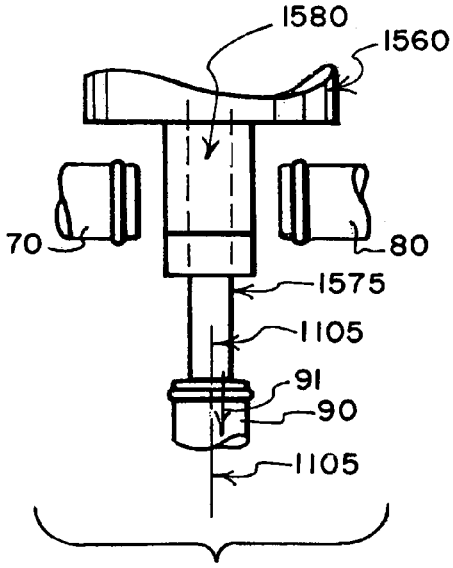

Likewise, as is depicted in FIG. 35, a turnable outer operating element 1580 of the type depicted in FIGS. 33 and 34 can extend between a pair of leftwardly and rightwardly movable actuators 70, 80 without engaging and operating the actuators 70, 80 until the operating element 1580 is turned (in the manner illustrated by the operating element 1580 in FIG. 34), and the rearwardly extensible inner rear operating element 1575 also can be utilized when extended as depicted in FIG. 36 to rearwardly move yet another actuator member 90 as indicated by the arrow 91.

Those skilled in the art will appreciate that the independently forwardly and rearwardly movable inner and outer operating members 1575, 1580 described and depicted herein can be used in many other ways to independently and collectively operate various other individual actuators and/or sets of actuators to control a variety of auxiliary devices (not shown)—which is to say that the enhanced push button actuator unit 1000 offers far greater control versatility than was provided by the single rearwardly movable but non-turnable rear operating element 580 of the prior art actuator 100 disclosed in the EPBA Patents referenced above.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the patent shall cover by suitable expression in the appended claims whatever features of patentable novelty exist in the invention disclosed.

The invention claimed is:

1. A push button actuator having a housing, a forwardly biased push button at the front of the housing depressable rearwardly along an axis of a passage that extends forwardly-rearwardly through the housing, and first and second operating elements at the rear of the housing, with the first operating element being movable to extend farther rearwardly from the housing than the second operating element in response to depression of the push button while turned about the axis to a first orientation, and with the second operating element being movable to extend farther rearwardly from the housing than the first operating element in response to depression of the push button while turned about the axis to a second orientation different than the first orientation.

2. The push button actuator of claim 1 wherein the push button includes a lock mechanism having a keyway into which a key can be inserted and turned about the axis to the first orientation to cause the lock mechanism to prevent said rearward movement of the second operating element, and to the second orientation to cause the lock mechanism to permit said rearward movement of the second operating element, with the lock mechanism also being adapted to permit key insertion into and key removal from the keyway only when turned about the axis to the first and second orientations.

3. The push button actuator of claim 2 wherein the first and second operating elements extend substantially concentrically along the axis at the rear of the housing with at least a portion of the second operating element extending around and protectively enclosing at least a portion of the first operating element.

4. The push button actuator of claim 1 wherein the second operating element includes a part that can turn about the axis situated at the rear of a generally cylindrical plunger part of the second operating element that is translatable along but not turnable about the axis.

5. The push button actuator of claim 1 wherein the first and second operating elements extend concentrically along the axis, with the second operating element enclosing at least a part of the first operating element.

6. The push button actuator of claim 1 wherein the first operating element has an elongate portion of substantially uniform non-circular cross-section extending along the axis through a portion of the second operating element which receives the elongate portion of the first operating element in a slip fit that facilitates independent translation of the first and second operating elements along the axis while establishing a driving connection between the first and second operating elements that causes the first and second operating elements to turn in unison about the axis.

7. The push button actuator of claim 6 wherein the first operating element is connected to a portion of the push button that can be turned about the axis by a key inserted into a keyway of the push button, whereby the first and second operating elements are caused to turn about the axis in unison with said portion of the push button.

8. The push button actuator of claim 1 additionally including an annular disc extending transversely across a part of the passage and installed in a transversely extending slot defined by the housing, a first spring in the passage at a location in front of the disc that biases the push button and the first operating element forwardly along the axis relative to the housing, and a second spring in the passage at a location behind the disc that biases the second operating element forwardly along the axis relative to the housing.

9. The push button actuator of claim 1 wherein the second operating element includes a generally cylindrical plunger part that is translatable along but not turnable about the axis, and a rear part situated behind the plunger part and connected to the plunger part to translate along the axis with the plunger part and to turn relative to the plunger part about the axis in unison with the push button.

10. The push button actuator of claim 9 in combination with an auxiliary member situated along the axis behind the push button actuator and defining a generally rectangular opening into which the rear part of the second operating element can extend without engaging and without moving the auxiliary member when the push button is turned to the first orientation.

11. The actuator of claim 1 wherein the push button includes a key lock assembly that retains the push button in a depressed position when depressed while turned to the first orientation, and that does not retain the push button in the depressed position when depressed while turned to the second orientation.

12. The actuator of claim 1 wherein the forwardly biased push button is adapted to return to the extended position when depressed then released while turned to the first orientation, and to be retained in a depressed position when depressed then released while being turned to the second orientation.

13. A push button actuator comprising a housing having a passage extending forwardly-rearwardly there-through along a central axis, and having components movable along the central axis including a) a forwardly-biased front push button movable along the central axis between an extended position projecting forwardly from the passage and a depressed position protectively nested in a front part of the passage, b) a lock mechanism in the front push button defining a keyway that can be turned by a key inserted into the keyway between locked and unlocked orientations about the central axis, c) first and second rear operating elements extending rearwardly from the passage along the central axis, d) with only the first rear operating element being adapted to move rearwardly in response to the front push button being moved rearwardly to the depressed position at a time when the keyway is turned to the locked orientation, and with the second rear operating element being adapted to move rearwardly in response to the front push button being moved rearwardly to the depressed position at a time when the keyway is turned to the unlocked orientation.

14. The push button actuator of claim 13 wherein the first rear operating element is adapted to extend rearwardly along the central axis beyond the second rear operating element when the front push button is moved along the central axis to a depressed position while turned to the locked orientation, and wherein the second rear operating element is adapted to extend rearwardly along the central axis beyond the first rear operating element when the front push button is moved along the central axis to the depressed position while turned to the unlocked orientation.

15. The push button actuator of claim 13 wherein the first and second rear operating elements extend concentrically along the central axis with a portion of the second rear operating element surrounding a portion of the first rear operating element.

16. The push button actuator of claim 15 wherein the second rear operating element receives the first rear operating element in a slip fit that permits smooth relative movement of the first and second rear operating elements along the central axis while drivingly connecting the first and second rear operating elements to turn in unison about the central axis.

17. A push button actuator, comprising:

a) a housing having a passage extending forwardly-rearwardly therethrough along a central axis;

b) a push button assembly movable along the central axis including i) a forwardly biased push button near a front end of the passage that can be depressed from a normally extended position to a depressed position and can be turned between first and second orientations, and ii) inner and outer operating elements near a rear end of the passage that extend one about the other and are adapted to move relative to each other differently when the push button is depressed while turned to the first orientation than when the push button is depressed while turned to the second orientation.

18. The actuator of claim 17 wherein the outer operating element extends rearwardly beyond the inner operating element when the push button is depressed while turned to the second orientation, and the inner operating element extends rearwardly beyond the outer operating element when the push button is depressed while turned to the first orientation.

19. The actuator of claim 17 wherein the outer operating element defines a formation configured to engage and move an auxiliary member when the outer operating element is turned to a selected one of the first and second orientations, but not when turned to the other of the first and second orientations.

20. The actuator of claim 17 wherein the inner and outer elements are operative to engage and move a different one of two auxiliary members when the push button is depressed while turned to the first orientation than when depressed while turned to the second orientation.

21. A push button actuator having a housing defining a passage therethrough extending forwardly-rearwardly along a central axis about which a forwardly biased push button at the front of the passage and inner and outer concentrically arranged operating elements at the rear of the passage are drivingly connected to turn in unison, with the inner rear operating element being movable rearwardly along the axis in unison with the push button when the push button is depressed while turned about the axis to one orientation, and with the outer rear operating element being movable rearwardly along the axis in unison with the push button when the push button is depressed while turned about the axis to an orientation different than the one orientation.

22. The push button actuator of claim 21 additionally including first and second actuating members situated behind the push button, with the first actuating member positioned to be engaged and moved by the outer rear operating member when moved rearwardly along the central axis, and with the second actuator member positioned to be engaged and moved by the inner rear operating member when moved rearwardly along the central axis.

23. A push button actuator having a depressable push button turnable between first and second orientations and having first and second concentrically arranged and rearwardly extending operating elements that move rearwardly independently of each other with one extending rearwardly beyond the other in response to depression of the push button when turned to the first orientation, and with the other extending rearwardly beyond the one in response to depression of the push button when turned to the second orientation.

24. The push button actuator of claim 23 wherein a) the second operating element surrounds the first operating element and is configured to align with and to move rearwardly to engage and operate an auxiliary device only when the push button is depressed while turned to the second orientation, and b) the second operating element is prevented from moving rearwardly in response to depression of the push button when turned to the first orientation.

* * * * *